US010057673B2

(12) United States Patent
Hong et al.

(10) Patent No.: US 10,057,673 B2
(45) Date of Patent: Aug. 21, 2018

(54) ELECTRONIC DEVICE AND OPERATING METHOD THEREOF

(71) Applicant: Samsung Electronics Co., Ltd., Gyeonggi-do (KR)

(72) Inventors: Ilsung Hong, Seoul (KR); Chang-Sik Kim, Gyeonggi-do (KR); Jae-Hyun Jo, Gyeonggi-do (KR); Sanghyun Han, Gyeonggi-do (KR); Donghyoun Son, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 15/455,380

(22) Filed: Mar. 10, 2017

(65) Prior Publication Data

US 2017/0264987 A1 Sep. 14, 2017

(30) Foreign Application Priority Data

Mar. 10, 2016 (KR) ..... 10-2016-0028897

(51) Int. Cl.
*H04R 1/00* (2006.01)
*H04R 1/10* (2006.01)

(52) U.S. Cl.
CPC ..... *H04R 1/1025* (2013.01); *H04R 1/1041* (2013.01); *H04R 1/1091* (2013.01); *H04R 2420/07* (2013.01)

(58) Field of Classification Search
CPC . G06F 1/3207; H04R 1/1041; H04R 2420/07; H04R 1/1066; H04R 5/033; H04R 1/105
USPC ..... 381/74, 79, 309
See application file for complete search history.

(56) References Cited

U.S. PATENT DOCUMENTS

2003/0229813 A1* 12/2003 Shiiyama ..... G06F 1/3203 713/300
2007/0162169 A1* 7/2007 Watanuki ..... G11C 7/16 700/94
2013/0051589 A1* 2/2013 Ide ..... H04R 1/1025 381/309

(Continued)

FOREIGN PATENT DOCUMENTS

DE 102014100824 7/2015

*Primary Examiner* — Melur Ramakrishnaiah
(74) *Attorney, Agent, or Firm* — The Farrell Law Firm, P.C.

(57) ABSTRACT

An audible device is provided. The audible device includes a battery which is rechargeable, a power management circuit configured to detect a first battery level of the battery, a wireless communication circuit configured to communicate with another audible device by wireless communication, an electronic component, and a control circuit electrically connected with the power management circuit, the wireless communication circuit, and the electronic component, wherein the control circuit is configured to: establish a connection with the another audible device by using the wireless communication circuit; receive a second battery level of the another audible device by using the wireless communication circuit; obtain a battery ratio between the first battery level and the second battery level; compare the battery ratio with at least one of a plurality of reference ratios; and control the operation of at least one of the audible device and the another audible device based the compared battery ratio.

20 Claims, 20 Drawing Sheets

(56) References Cited

U.S. PATENT DOCUMENTS

| | | | | |
|---|---|---|---|---|
| 2013/0116015 | A1* | 5/2013 | Lee | H04R 1/1025<br>455/569.1 |
| 2013/0266152 | A1* | 10/2013 | Haynie | H04R 5/033<br>381/80 |
| 2015/0326990 | A1* | 11/2015 | Yeh | H04R 1/1041<br>381/311 |

* cited by examiner

ELECTRONIC DEVICE AND OPERATING METHOD THEREOF

PRIORITY

This application claims priority under 35 U.S.C. § 119(a) to Korean Patent Application Serial No. 10-2016-0028897, which was filed in the Korean Intellectual Property Office on Mar. 10, 2016, the entire content of which is incorporated herein by reference.

BACKGROUND

1. Field of the Disclosure

The present disclosure generally relates to a double-ear separate type of audible device and to an operating method thereof.

2. Description of the Related Art

Recently, with the development of digital technology, various types of electronic devices ((such as mobile communication terminals, smart phones, tablet PCs (personal computers), PDAs (personal digital assistants), electronic organizers, notebook computers, wearable devices, IoT (internet of things) devices, or audible devices)) have been widely used.

The electronic devices may be connected with a variety of audible devices (e.g., audio output devices, such as wired headsets, wired earphones, wireless headsets, or wireless earphones). The electronic device may output reproduced audio data (e.g., sound sources) through an audible device that is connected thereto, and a user may listen to the audio data of the electronic device through the audible device. The electronic device and the audible device may be connected with each other through a wired interface (e.g., a connector connection) or a wireless interface (a Bluetooth connection).

In recent years, a double-ear separate type of wireless earphone has been developed as an audible device that operates in pairs. Such a wireless earphone may include the first earpiece and the second earpiece, which are worn in the user's ears, respectively, and each earpiece may include a battery. In the wireless earphone, the earpieces may have different battery voltages depending on the usage method and environment. According to this, the low voltage earpiece may be turned off first among the earpieces, so the user may not listen to the stereo music.

SUMMARY

Accordingly to an aspect of the present disclosure provides, a method for controlling a work distribution of audible devices that are able to operate in pairs by interworking through wireless communication, and function provide a device thereof.

In accordance with an aspect of the present disclosure, there is provided an audible device. The audible device includes a battery which is rechargeable, a power management circuit configured to detect a first battery level of the battery, a wireless communication circuit configured to communicate with another audible device by wireless communication, an electronic component, and a control circuit electrically connected with the power management circuit, the wireless communication circuit, and the electronic component, wherein the control circuit is configured to: establish a connection with the another audible device by using the wireless communication circuit; receive a second battery level of the another audible device by using the wireless communication circuit; obtain a battery ratio between the first battery level and the second battery level; compare the battery ratio with at least one of a plurality of reference ratios; and control the operation of at least one of the audible device and the another audible device based the compared battery ratio.

In accordance with an aspect of the present disclosure, there is provided an electronic device. The electronic device includes a wireless communication circuit configured to communicate with an audible device by wireless communication and a processor electrically connected with the wireless communication circuit, wherein the processor is configured to: establish a connection with one of the first audible device and a second audible device by using the wireless communication circuit; receive one of first data related to the first audible device and second data related to the second audible device from whichever of the first audible device and second audible device is connected to the electronic device using the wireless communication circuit; and control the operation of at least one of the first audible device and the second audible device based on one of the first data and the second data.

In accordance with an aspect of the present disclosure, there is provided an operating method of an audible device. The method includes establishing a connection with another audible device by using a wireless communication circuit, receiving a second battery level of the another audible device by using the wireless communication circuit, detecting a first battery level of the audible device, obtaining a battery ratio between the first battery level and the second battery level, comparing the battery ratio with at least one of a plurality of reference ratios, and controlling the operation of at least one of the audible device and the another audible device based on the compared battery ratio.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1:
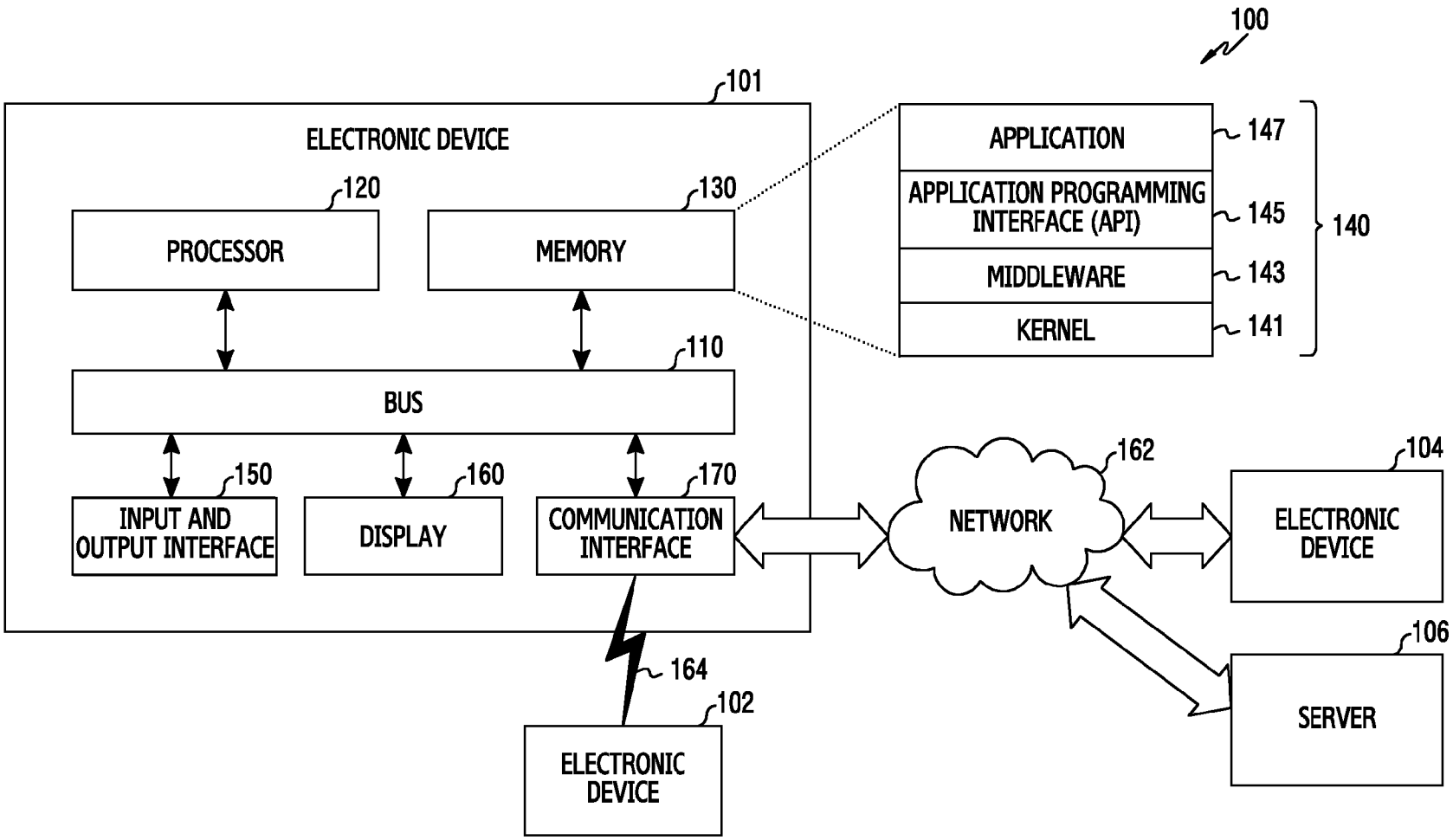
FIG. 1 is a diagram illustrating a network environment that includes an electronic device, according to an embodiment of the present disclosure.

Embodiments of the present disclosure will be described herein below with reference to the accompanying drawings. However, the embodiments of the present disclosure are not limited to the specific embodiments and should be construed as including all modifications, changes, equivalent devices and methods, and/or alternative embodiments of the present disclosure.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable" of according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a CPU or an application processor) capable of performing a corresponding operation by executing one or more software programs stored in a memory device.

The term "module" as used herein may be defined as, for example, a unit including one of hardware, software, and firmware or two or more combinations thereof. The term "module" may be interchangeably used with, for example, the terms "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include at least one of an application-specific integrated circuit (ASIC) chip, field-programmable gate arrays (FPGAs), or a programmable-logic device, which is well known or will be developed in the future, for performing certain operations.

The terms used in describing the various embodiments of the present disclosure are for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

An electronic device according to various embodiments of the present disclosure may include at least one of, for example, a smart phone, a tablet Personal Computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

The electronic device may be a home appliance. The home appliance may include at least one of, for example, a television, a digital video disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

The electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment devices, an electronic devices for a ship (e.g., a navigation device for a ship, and a gyro-compass), avionics, security devices, an automotive head unit, a robot for home or industry, an automatic teller's machine (ATM) in banks, point of sales (POS) devices in a shop, or an internet device of things (IoT) devices (e.g., a light bulb, various sensors, electric or gas meter, a sprinkler device, a fire alarm, a thermostat, a streetlamp, a toaster, a sporting goods, a hot water tank, a heater, a boiler, etc.).

The electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may be a flexible device. Further, the electronic is not limited to the aforementioned devices, and may include a new electronic device according to the development of technology.

Hereinafter, an electronic device will be described with reference to the accompanying drawings. As used herein, the term "user" may indicate a person who uses an electronic device or a device (e.g., an artificial intelligence electronic device) that uses an electronic device.

FIG. 1 is a diagram illustrating a network environment including an electronic device, according to an embodiment of the present disclosure.

An electronic device 101 within a network environment 100 will be described with reference to FIG. 1. The electronic device 101 may include a bus 110, a processor 120, a memory 130, an input/output interface 150, a display 160, and a communication interface 170. The electronic device 101 may omit at least one of the above components or may further include other components.

The bus 110 may include, for example, a circuit which interconnects the components 110 to 170 and delivers a communication (e.g., a control message and/or data) between the components 110 to 170.

The processor 120 may include one or more of a central processing Unit (CPU), an application processor (AP), and a communication processor (CP). The processor 120 may carry out, for example, calculation or data processing relating to control and/or communication of at least one other component of the electronic device 101.

The memory 130 may include a volatile memory and/or a non-volatile memory. The memory 130 may store, for example, commands or data relevant to at least one other component of the electronic device 101. The memory 130 may store software and/or a program 140. The program 140 may include, for example, a kernel 141, middleware 143, an application programming Interface (API) 145, and/or application programs (or "applications") 147. At least some of the kernel 141, the middleware 143, and the API 145 may be referred to as an Operating System (OS).

The kernel 141 may control or manage system resources (e.g., the bus 110, the processor 120, or the memory 130) used for performing an operation or function implemented in the other programs (e.g., the middleware 143, the API 145, or the application programs 147). Furthermore, the kernel 141 may provide an interface through which the middleware 143, the API 145, or the application programs 147 may access the individual components of the electronic device 101 to control or manage the system resources.

The middleware 143, for example, may serve as an intermediary for allowing the API 145 or the application programs 147 to communicate with the kernel 141 to exchange data.

Also, the middleware 143 may process one or more task requests received from the application programs 147 according to priorities thereof. For example, the middleware 143 may assign priorities for using the system resources (e.g., the bus 110, the processor 120, the memory 130, or the like) of the electronic device 101, to at least one of the application programs 147. For example, the middleware 143 may perform scheduling or loading balancing on the one or more task requests by processing the one or more task requests according to the priorities assigned thereto.

The API 145 is an interface through which the applications 147 control functions provided from the kernel 141 or the middleware 143, and may include, for example, at least one interface or function (e.g., instruction) for file control, window control, image processing, character control, and the like.

The input/output interface 150, for example, may function as an interface that may transfer commands or data input from a user or another external device to the other element(s) of the electronic device 101. Furthermore, the input/output interface 150 may output the commands or data received from the other element(s) of the electronic device 101 to the user or another external device.

Examples of the display 160 may include a liquid crystal display (LCD), a light-emitting diode (LED) display, an organic light-emitting diode (OLED) display, a microelectromechanical systems (MEMS) display, and an electronic paper display. The display 160 may display, for example, various types of contents (e.g., text, images, videos, icons, or symbols) to users. The display 160 may include a touch screen, and may receive, for example, a touch, gesture, proximity, or hovering input using an electronic pen or a user's body part.

The communication interface 170 may establish communication, for example, between the electronic device 101 and a first external electronic device 102, a second external electronic device 104, or a server 106. For example, the communication interface 170 may be connected to a network 162 through wireless or wired communication, and may communicate with the second external electronic device 104 or the server 106. The wireless communication may use at least one of, for example, long term evolution (LTE), LTE-Advance (LTE-A), code division multiple access (CDMA), wideband CDMA (WCDMA), universal mobile telecommunications system (UMTS), wireless broadband (WiBro), and global system for mobile communications (GSM), as a cellular communication protocol. In addition, the wireless communication may include, for example, short range communication 164. The short-range communication 164 may include at least one of, for example, Wi-Fi, Bluetooth, near field communication (NFC), and global navigation satellite system (GNSS). GNSS may include, for example, at least one of global positioning system (GPS), global navigation satellite system (Glonass), Beidou Navigation satellite system (Beidou) or Galileo, and the European global satellite-based navigation system, based on a location, a bandwidth, or the like. Hereinafter, in the present disclosure, the "GPS" may be interchangeably used with the "GNSS". The wired communication may include, for example, at least one of a universal serial bus (USB), a high definition multimedia interface (HDMI), recommended standard 232 (RS-232), and a plain old telephone Service (POTS). The network 162 may include at least one of a telecommunication network such as a computer network (e.g., a LAN or a WAN), the Internet, and a telephone network.

Each of the first and second external electronic devices 102 and 104 may be of a type identical to or different from that of the electronic device 101. The server 106 may include a group of one or more servers.

All or some of the operations performed in the electronic device 101 may be executed in another electronic device or a plurality of electronic devices (e.g., the electronic devices 102 and 104 or the server 106). When the electronic device 101 has to perform some functions or services automatically or in response to a request, the electronic device 101 may request the electronic device 102 or 104 or the server 106 to execute at least some functions relating thereto instead of or in addition to autonomously performing the functions or services. The electronic device 102 or 104, or the server 106 may execute the requested functions or the additional functions, and may deliver a result of the execution to the electronic device 101. The electronic device 101 may process the received result as it is or additionally, and may provide the requested functions or services. To this end, for example, cloud computing, distributed computing, or client-server computing technologies may be used.

Figure 2:
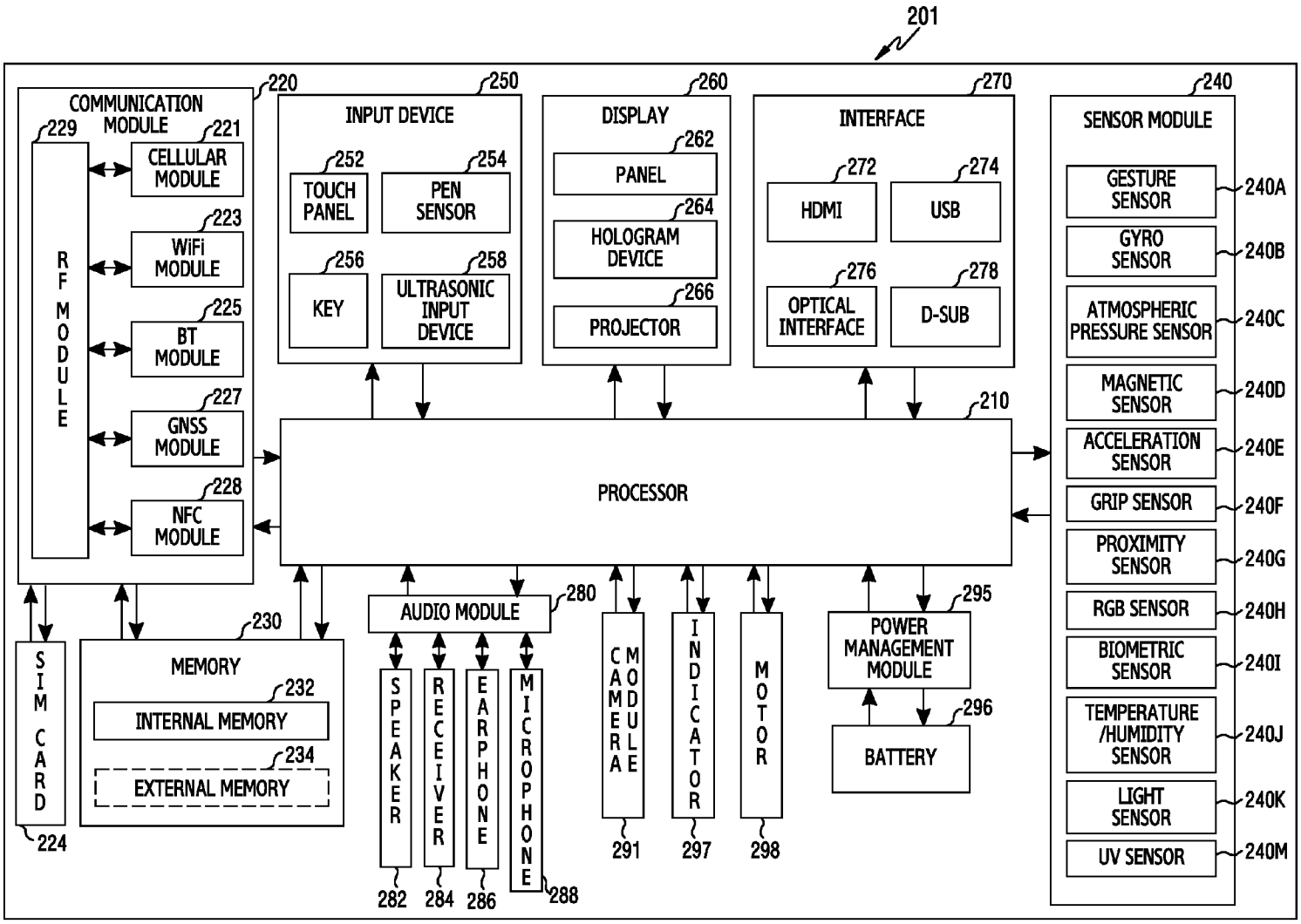
FIG. 2 is a diagram illustrating an electronic device, according to an embodiment of the present disclosure.

FIG. 2 is a diagram illustrating an electronic device, according to an embodiment of the present disclosure.

The electronic device 201 may include, for example, all or a part of the electronic device 101 shown in FIG. 1. The electronic device 201 may include one or more processors 210 (e.g., application processors (AP)), a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

The processor 210 may control a plurality of hardware or software components connected to the processor 210 by driving an operating system or an application program, and perform processing of various pieces of data and calculations. The processor 210 may be embodied as, for example, a system on chip (SoC). The processor 210 may further include a graphic processing unit (GPU) and/or an image signal processor. The processor 210 may include at least some (for example, a cellular module 221) of the components illustrated in FIG. 2. The processor 210 may load, into a volatile memory, commands or data received from at least one (e.g., a non-volatile memory) of the other components and may process the loaded commands or data, and may store various data in a non-volatile memory.

The communication module 220 may have a configuration equal or similar to that of the communication interface 170 of FIG. 1. The communication module 220 may include, for example, a cellular module 221, a Wi-Fi module 223, a BT module 225, a GNSS module 227 (e.g., a GPS module 227, a Glonass module, a Beidou module, or a Galileo module), an NFC module 228, and a radio frequency (RF) module 229.

The cellular module 221, for example, may provide a voice call, a video call, a text message service, or an Internet service through a communication network. The cellular module 221 may distinguish and authenticate the electronic device 201 in a communication network using the SIM card 224. The cellular module 221 may perform at least some of the functions that the AP 210 may provide. The cellular module 221 may include a communication processor (CP).

For example, each of the Wi-Fi module 223, the BT module 225, the GNSS module 227, and the NFC module 228 may include a processor for processing data transmitted/received through a corresponding module. At least some (e.g., two or more) of the cellular module 221, the Wi-Fi module 223, the BT module 225, the GNSS module 227, and the NFC module 228 may be included in one integrated chip (IC) or IC package.

The RF module 229, for example, may transmit/receive a communication signal (e.g., an RF signal). The RF module 229 may include, for example, a transceiver, a power amplifier module (PAM), a frequency filter, a low noise amplifier (LNA), and an antenna. At least one of the cellular module 221, the WIFI module 223, the BT module 225, the GNSS module 227, and the NFC module 228 may transmit/receive an RF signal through a separate RF module.

The SIM 224 may be an embedded SIM, and may contain unique identification information (e.g., an integrated circuit card identifier (ICCID)) or subscriber information (e.g., an international mobile subscriber identity (IMSI)).

The memory 230 may include, for example, an embedded memory 232 or an external memory 234. The embedded memory 232 may include at least one of a volatile memory (e.g., a dynamic random access memory (DRAM), a static RAM (SRAM), a synchronous dynamic RAM (SDRAM), and the like) and a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), a hard disc drive, a solid state drive (SSD), and the like).

The external memory 234 may further include a flash drive, for example, a compact flash (CF), a secure digital (SD), a micro secure digital (Micro-SD), a mini secure digital (Mini-SD), an eXtreme digital (xD), a multimediacard (MMC), a memory stick, or the like. The external memory 234 may be functionally and/or physically connected to the electronic device 201 through various interfaces.

The sensor module 240, for example, may measure a physical quantity or detect an operation state of the electronic device 201, and may convert the measured or detected information into an electrical signal. The sensor module 240 may include, for example, at least one of a gesture sensor 240A, a gyro sensor 240B, an atmospheric pressure sensor (barometer) 240C, a magnetic sensor 240D, an acceleration sensor 240E, a grip sensor 240F, a proximity sensor 240G, a color sensor 240H (e.g., red, green, and blue (RGB) sensor), a biometric sensor (medical sensor) 2401, a temperature/humidity sensor 240J, an illuminance sensor 240K, and a ultra violet (UV) sensor 240M. Additionally or alternatively, the sensor module 240 may include, for example, an E-nose sensor, an electromyography (EMG) sensor, an electroencephalogram (EEG) sensor, an electrocardiogram (ECG) sensor, an Infrared (IR) sensor, an iris scan sensor, and/or a finger scan sensor. The sensor module 240 may further include a control circuit for controlling one or more sensors included therein. The electronic device 201 may further include a processor configured to control the sensor module 240, as a part of the processor 210 or separately from the processor 210, and may control the sensor module 240 while the processor 210 is in a sleep state.

The input device 250 may include, for example, a touch panel 252, a (digital) pen sensor 254, a key 256, or an ultrasonic input device 258. The touch panel 252 may use, for example, at least one of a capacitive type, a resistive type, an infrared type, and an ultrasonic type. The touch panel 252 may further include a control circuit. The touch panel 252 may further include a tactile layer, and provide a tactile reaction to the user.

The (digital) pen sensor 254 may include, for example, a recognition sheet which is a part of the touch panel or is separated from the touch panel. The key 256 may include, for example, a physical button, an optical key or a keypad. The ultrasonic input device 258 may detect, through a microphone 288, ultrasonic waves generated by an input tool, and identify data corresponding to the detected ultrasonic waves.

The display 260 may include a panel 262, a hologram device 264, or a projector 266. The panel 262 may include a configuration identical or similar to the display 160 illustrated in FIG. 1. The panel 262 may be implemented to be, for example, flexible, transparent, or wearable. The panel 262 may be embodied as a single module with the touch panel 252. The hologram device 264 may show a three dimensional (3D) image in the air by using an interference of light. The projector 266 may project light onto a screen to display an image. The screen may be located, for example, in the interior of or on the exterior of the electronic device 201. The display 260 may further include a control circuit for controlling the panel 262, the hologram device 264, or the projector 266.

The interface 270 may include, for example, a high-definition multimedia interface (HDMI) 272, a universal serial bus (USB) 274, an optical interface 276, or a d-sub-miniature (D-sub) 278. The interface 270 may be included in, for example, the communication interface 170 illustrated in FIG. 1. Additionally or alternatively, the interface 270 may include, for example, a mobile high-definition link (MHL) interface, a secure digital (SD) card/multi-media card (MMC) interface, or an infrared data association (IrDA) standard interface.

The audio module 280, for example, may bilaterally convert a sound and an electrical signal. At least some components of the audio module 280 may be included in, for example, the input/output interface 150 illustrated in FIG. 1. The audio module 280 may process voice information input or output through, for example, a speaker 282, a receiver 284, earphones 286, or the microphone 288.

The camera module 291 is, for example, a device which may photograph a still image and a video. The camera module 291 may include one or more image sensors (e.g., a front sensor or a back sensor), a lens, an image signal processor (ISP) or a flash (e.g., light emitting diode (LED) or xenon lamp).

The power management module 295 may manage, for example, power of the electronic device 201. The power management module 295 may include a power management integrated circuit (PMIC), a charger integrated circuit (IC), or a battery gauge. The PMIC may use a wired and/or wireless charging method. Examples of the wireless charging method may include, for example, a magnetic resonance method, a magnetic induction method, an electromagnetic wave method, and the like. Additional circuits (e.g., a coil loop, a resonance circuit, a rectifier, etc.) for wireless charging may be further included. The battery gauge may measure, for example, a residual quantity of the battery 296, and a voltage, a current, or a temperature while charging. The battery 296 may include, for example, a rechargeable battery and/or a solar battery.

The indicator 297 may display a particular state (e.g., a booting state, a message state, a charging state, or the like) of the electronic device 201 or a part (e.g., the processor 210) of the electronic device 201. The motor 298 may convert an electrical signal into a mechanical vibration, and may generate a vibration, a haptic effect, or the like. Although not illustrated, the electronic device 201 may include a processing device (e.g., a GPU) for supporting a mobile TV. The processing device for supporting a mobile TV may process, for example, media data according to a certain standard such as digital multimedia broadcasting (DMB), digital video broadcasting (DVB), or mediaFLO™.

Each of the above-described component elements of hardware according to the present disclosure may be configured with one or more components, and the names of the corresponding component elements may vary based on the type of electronic device. The electronic device may include at least one of the above-described elements. Some of the above-described elements may be omitted from the electronic device, or the electronic device may further include additional elements. Also, some of the hardware components according to various embodiments may be combined into one entity, which may perform functions identical to those of the relevant components before the combination.

Figure 3:
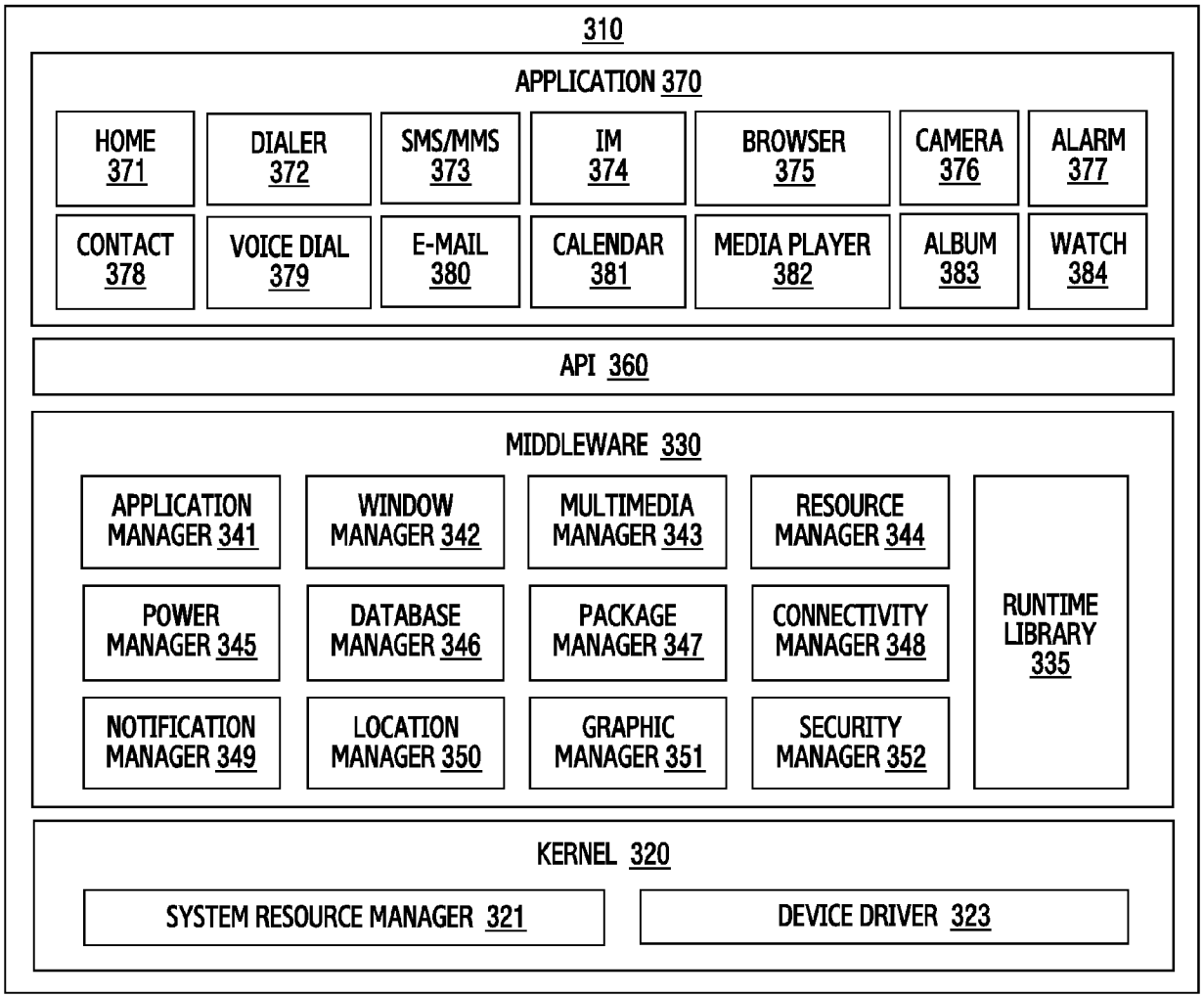
FIG. 3 is a diagram of a program module, according to an embodiment of the present disclosure.

FIG. 3 is a diagram illustrating a program module, according to an embodiment of the present disclosure.

The program module 310 may include an operating system (OS) for controlling resources related to the electronic device and/or various applications (e.g., the application programs 147) executed in the operating system. The operating system may be, for example, Android, iOS, Windows, Symbian, Tizen, Bada, or the like.

The program module 310 may include a kernel 320, middleware 330, an API 360, and/or applications 370. At least some of the program module 310 may be preloaded on an electronic device, or may be downloaded from an external electronic device (e.g., the electronic device 102 or 104, or the server 106).

The kernel 320 may include, for example, a system resource manager 321 and/or a device driver 323. The system resource manager 321 may control, allocate, or collect system resources. The system resource manager 321 may include a process management unit, a memory management unit, a file system management unit, and the like. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

For example, the middleware 330 may provide a function required in common by the applications 370, or may provide various functions to the applications 370 through the API 360 so as to enable the applications 370 to efficiently use the limited system resources in the electronic device. The middleware 330 may include at least one of a run time library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include a library module that a compiler uses in order to add a new function through a programming language while an application 370 is being executed. The runtime library 335 may perform input/output management, memory management, the functionality for an arithmetic function, or the like.

The application manager 341 may manage, for example, a life cycle of at least one of the applications 370. The window manager 342 may manage graphical user interface (GUI) resources used by a screen. The multimedia manager 343 may recognize a format required for reproduction of various media files, and may perform encoding or decoding of a media file by using a codec suitable for the corresponding format. The resource manager 344 may manage resources of a source code, a memory, and a storage space of at least one of the applications 370.

The power manager 345 may operate together with, for example, a basic input/output system (BIOS) or the like to manage a battery or power source and may provide power information or the like required for the operations of the electronic device. The database manager 346 may generate, search for, and/or change a database to be used by at least one of the applications 370. The package manager 347 may manage installation or an update of an application distributed in a form of a package file.

For example, the connectivity manager 348 may manage wireless connectivity such as Wi-Fi or Bluetooth. The notification manager 349 may display or notify of an event such as an arrival message, promise, proximity notification, and the like in such a way that does not disturb a user. The location manager 350 may manage location information of an electronic device. The graphic manager 351 may manage a graphic effect which will be provided to a user, or a user interface related to the graphic effect. The security manager 352 may provide all security functions required for system security, user authentication, or the like. According to an embodiment of the present disclosure, when the electronic device has a telephone call function, the middleware 330 may further include a telephony manager for managing a voice call function or a video call function of the electronic device.

The middleware 330 may include a middleware module that forms a combination of various functions of the above-described components. The middleware 330 may provide a module specialized for each type of OS in order to provide a differentiated function. Further, the middleware 330 may dynamically remove some of the existing components or add new components.

The API 360 (e.g., the API 145) is, for example, a set of API programming functions, and may be provided with a different configuration according to an OS. For example, in the case of Android or iOS, one API set may be provided for each platform. In the case of Tizen, two or more API sets may be provided for each platform.

The applications 370 may include, for example, one or more applications which may provide functions such as a home 371, a dialer 372, an SMS/MMS 373, an instant message (IM) 374, a browser 375, a camera 376, an alarm 377, contacts 378, a voice dial 379, an email 380, a calendar 381, a media player 382, an album 383, a clock 384, health care (e.g., measuring exercise quantity or blood sugar), or environment information (e.g., providing atmospheric pressure, humidity, or temperature information).

The applications 370 may include an application (hereinafter, referred to as an "information exchange application" for convenience of description) that supports exchanging information between the electronic device 101 and the electronic device 102 or 104. The information exchange application may include, for example, a notification relay application for transferring specific information to an external electronic device or a device management application for managing an external electronic device.

For example, the notification relay application may include a function of transferring, to the electronic device 102 or 104, notification information generated from other applications of the electronic device 101 (e.g., an SMS/MMS application, an e-mail application, a health management application, or an environmental information application). Further, the notification relay application may receive notification information from, for example, an external electronic device and provide the received notification information to a user.

The device management application may manage (e.g., install, delete, or update), for example, at least one function of an external electronic device (e.g., the electronic device 102 or 104) communicating with the electronic device (e.g., a function of turning on/off the external electronic device itself (or some components) or a function of adjusting the brightness (or a resolution) of the display), applications operating in the external electronic device, and services provided by the external electronic device (e.g., a call service or a message service).

The applications 370 may include applications (e.g., a health care application of a mobile medical appliance or the like) designated according to an external electronic device (e.g., attributes of the electronic device 102 or 104). The applications 370 may include an application received from the server 106, or the electronic device 102 or 104. The applications 370 may include a preloaded application or a third party application that may be downloaded from a server. The names of the components of the program module 310 of the illustrated embodiment of the present disclosure may change according to the type of operating system.

At least a part of the programming module 310 may be implemented in software, firmware, hardware, or a combination of two or more thereof. At least some of the program module 310 may be implemented (e.g., executed) by, for example, a processor. At least some of the program module 310 may include, for example, a module, a program, a routine, a set of instructions, and/or a process for performing one or more functions.

At least some of the devices (for example, modules or functions thereof) or the method (for example, operations) may be implemented by a command stored in a non-transitory computer-readable storage medium in a programming module form. The instruction, when executed by the processor 120, may cause the one or more processors to execute the function corresponding to the instruction. The non-transitory computer-readable recoding media may be, for example, the memory 130.

The non-transitory computer-readable recoding medium may include a hard disk, a floppy disk, magnetic media (e.g., a magnetic tape), optical media (e.g., a compact disc (CD)-ROM and a digital versatile disc (DVD)), magneto-optical media (e.g., a floptical disk), a hardware device (e.g., a ROM, a RAM, a flash memory, etc.), and the like. In addition, the program instructions may include high class language codes, which can be executed in a computer by using an interpreter, as well as machine codes made by a compiler. The aforementioned hardware device may be configured to operate as one or more software modules in order to perform the operation of the present disclosure, and vice versa.

Any of the modules or programming modules may include at least one of the above described elements, exclude some of the elements, or further include other additional elements. The operations performed by the modules, programming module, or other elements according to various embodiments of the present disclosure may be executed in a sequential, parallel, repetitive, or heuristic manner. Further, some operations may be executed according to another order or may be omitted, or other operations may be added.

The various embodiments of the present disclosure disclose a dynamic work distribution for the double-ear separate type of wireless audible device (or earpieces) (e.g., wireless earphones, wireless headsets, or the like). The low power operation of the audible device and the increase in the usability thereof may be provided according to the dynamic work distribution of the audible device.

A method for dynamically adjusting the works of each audible device according to the states of the audible devices (e.g., the battery state, the wearing state, or the like) that are able to operate in pairs by interworking with each other through wireless communication, and provide a device thereof. A method of dynamically exchanging works between two audible devices in order to thereby increase the battery usage of the audible device and in order to thereby improve the usability by dynamic role distribution, and provide a device thereof.

The electronic device, according the present disclosure, may include all devices that support a communication function and/or a charging function and use one or more various processors, such as an AR a CP, a GPU, and/or a CPU. For example, the electronic device, may include all information communication devices, multimedia devices, wearable devices, IoT devices, or audible devices, which include a battery and support a communication function and/or a charging function, or may include application devices thereof.

Hereinafter, an operating method and a device will be described with reference to the accompanying drawings. However, since the present disclosure is not restricted or limited by the following description, it should be noted that applications can be made to the various embodiments based on embodiments that will be described below. Hereinafter, various embodiments of the present disclosure will be described based on an approach of hardware. However, various embodiments of the present disclosure include a technology that uses both hardware and software and thus, the various embodiments of the present disclosure may not exclude the perspective of software.

Figure 4:
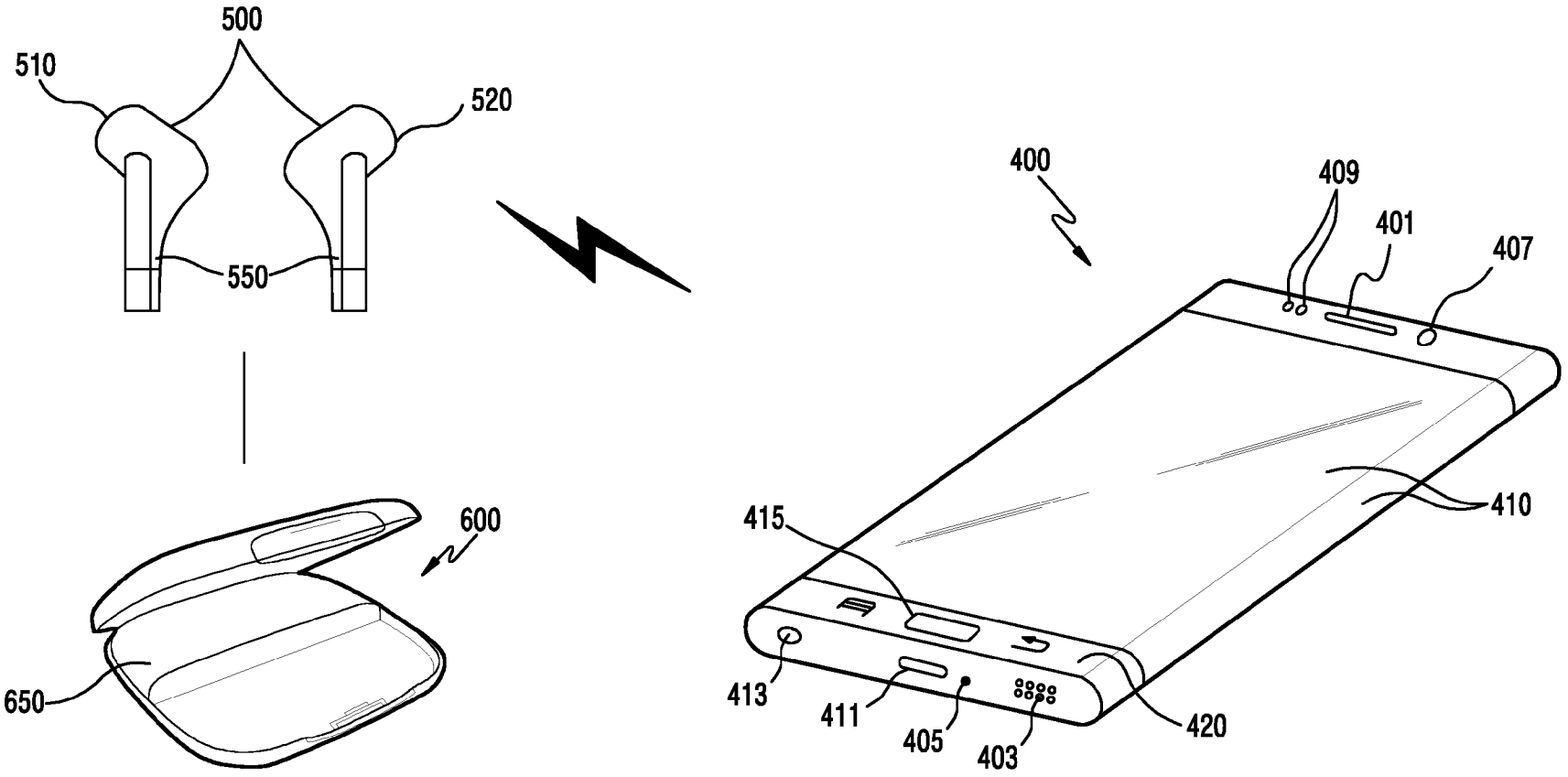
FIG. 4 is a diagram illustrating a system, according to an embodiment of the present disclosure.
Figure 5:
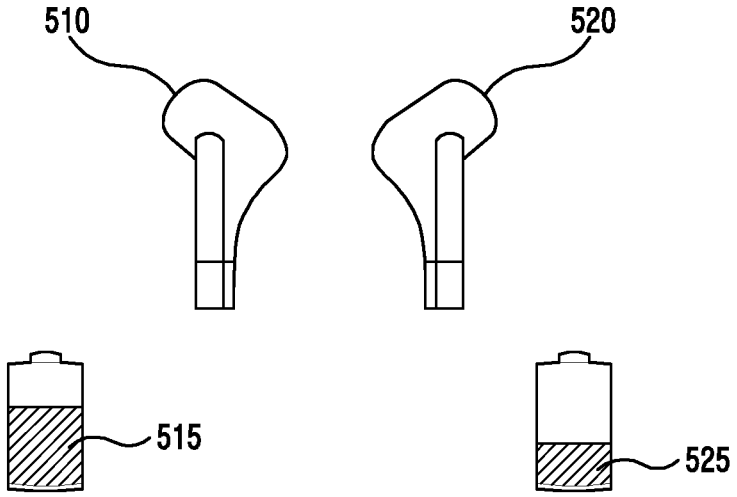
FIG. 5 is a diagram illustrating a battery level of an audible device in the system, according to an embodiment of the present disclosure.

FIG. 4 is a diagram illustrating a system, according to an embodiment of the present disclosure. FIG. 5 is a diagram illustrating a battery level of an audible device in the system, according to an embodiment of the present disclosure.

Referring to FIG. 4, the system may include an electronic device 400, audible devices 500, and a charging device 600.

The electronic device 400 may be configured to include: a display 410; a housing (or body) 420 on which the display 410 is mounted to be fixed; and additional devices that are formed in the housing 420 in order to thereby execute functions of the electronic device 400. The additional devices may include the first speaker 401, the second speaker 403, a microphone 405, sensors (such as a front camera module 407, an illuminance sensor 409, or the like), communication interfaces (e.g., a charging or data input/output port 411, an audio input/output port 413, or the like), a button 415, or the like.

The display 410 may include the flat panel type of display or a bent display that can be curved, bent, or rolled without being damaged through a thin and flexible substrate like paper. The bent display may be coupled to the housing 420 so that a curved shape thereof may be maintained. In addition to the bent display, the electronic device 400 may be implemented by a display device that can be freely bent and unfolded, such as flexible displays. The display 410 may have the flexibility to be folded and unfolded by replacing glass substrates, which enclose a liquid crystal in an, an LED, an OLED, or an active matrix OLED (AMOLED), with plastic films.

The electronic device 400 may be connected to one audible device (for example, the audible device that operates as a master among the audible devices 500) of the audible devices 500 (for example, the first audible device 510 and the second audible device 520). The electronic device 400 may be connected to the audible device 500 based on wireless communication ((e.g., Bluetooth, Bluetooth low energy (BLE), or the like)).

When the electronic device 400 is connected to the audible device 500, the electronic device 400 may determine state information (such as wearing state information or the battery level (e.g., information on the remaining amount of the battery)) corresponding to the audible device 500. The electronic device 400 may control the operation of the audible device 500 (e.g., the first audible device 510 or the second audible device 520) based on the state information of the audible device 500.

The electronic device 400, for example, may control at least one of the first audible device 510 or the second audible device 520 to perform the first work (e.g., a stereo audio output function based on the first audible device 510 and the second audible device 520) and the second work (e.g., a health coaching function for the user), which are performed by the interworking between the electronic device 400 and the audible devices 500.

When controlling the operation related to the first work and/or the second work of the audible device 500, based on whether or not the audible device 500 is worn on the user, the electronic device 400 may distribute the works of the audible device 500 such that the audible device 500, which is worn on the user's body (such as the ears), may perform the first work and/or the second work.

When controlling the operation related to the first work and/or the second work of the audible device 500, based on the balancing of the battery level between the first audible device 510 and the second audible device 520, the electronic device 400 may distribute the works of the audible device 500 such that the corresponding audible device 500 may perform the first work and/or the second work. For example, if the electronic device 400 detects that the battery level of one (e.g., the first audible device 510) of the first audible device 510 or the second audible device 520 is lowered to be equal to, or less than, a reference voltage (for example, 3.6V), the electronic device 400 may adjust the sound quality, which is to be transmitted to the audible device (e.g., the first audible device 510) of which the battery level is lowered to be equal to, or less than, the reference voltage, to be lower (for example, 192 Kbps→96 Kbps) than the sound quality that is transmitted to the other audible device (e.g., the second audible device 520), and may transmit the same.

The electronic device 400 may distribute the works of the audible device 500 such that at least one of the first audible device 510 or the second audible device 520 may perform the first work and/or the second work based on whether or not the audible device 500 is worn on the ear and based on the battery level.

The electronic device 400 may control the audible device, which is worn on the ear and of which the battery level is high, to operate the first work and the second work, which are performed by the interworking between the electronic device 400 and the audible device 500.

For example, as shown in FIG. 5, provided that both the first audible device 510 and the second audible device 520 are worn on the ears and the battery level (e.g., the remaining amount of the battery) 515 of the first audible device 510 is higher than the battery level (e.g., the remaining amount of the battery) 525 of the second audible device 520, the electronic device 400 may make a control to connect to the first audible device 510 and to allow the first audible device 510 to perform related operations.

As another example, when both the first audible device 510 and the second audible device 520 are worn on the ears and the electronic device 400 is connected with the second audible device 520 as a master, it may be assumed that the battery level (e.g., the remaining amount of the battery) 515 of the first audible device 510 becomes higher than the battery level (e.g., the remaining amount of the battery) 525 of the second audible device 520 or the second audible device 520 is taken off, as shown in FIG. 5. The electronic device 400 may make a control to change the roles (e.g., the master role or the slave role) of the first audible device 510 and the second audible device 520 (for example, change the first audible device 510 into a master and/or change the second audible device 520 into a slave), and may make a control to be directly paired with the first audible device 510 in order to thereby perform related operations based on the first audible device 510.

The electronic device 400 may determine the wearing or non-wearing state of the corresponding audible device 500 based on state information that is received from the first audible device 510 or the second audible device 520. The electronic device 400 may compare the voltage of the audible device 500 based on the state information that is received from the first audible device 510 or the second audible device 520, and may make a control to give priority for performing the operation to the audible device of a high voltage (e.g., the first audible device 510) to then perform the corresponding operation. The electronic device 400 may control the second audible device 520 to operate in the standby state (e.g., the sleep state) in order to thereby minimize the current consumption of the second audible device 520.

Although the battery level of the first audible device 510 is higher than the battery level of the second audible device 520, the user may wear only the second audible device 520 on the ear without recognizing the same. The electronic device 400 may obtain, from the audible device 500, sensed information that is measured by various sensors provided in the audible device 500, and may determine the audible device (e.g., at least one of the first audible device 510 or the second audible device 520) to be worn on the user's ear based on the same. For example, if the electronic device 400 detects that only the second audible device 520 is worn on the user's ear, even though the battery level of the first audible device 510 is higher than the battery level of the second audible device 520, the electronic device 400 may control the second audible device 520 to process the works that have been allocated to the first audible device 510.

Examples in which the electronic device 400 controls the operation according to the state information of the audible device 500 will be described in detail with reference to the drawings.

The audible device 500 may represent an audio output device that is connected with the electronic device 400 in wireless communication in order to thereby receive audio signals of sound sources (e.g., audio data) that are reproduced in the electronic device 400 and are transmitted through streaming, and in order to thereby output the received audio signals through a provided speaker (or a receiver). The audible device 500 may be configured by a pair of audible devices, such as the first audible device 510 and the second audible device 520 for the left ear and the right ear of the user, respectively. The audible device 500 including the first audible device 510 and the second audible device 520 may be worn on the user's body part (e.g., the left ear or the right ear), and may provide sound information through provided speakers (or receivers). The audible device 500 may be configured to include a processor, an input unit (e.g., a microphone, buttons, or the like), an output unit (e.g., a receiver/speaker), a communication circuit (e.g., a communication module), a storage unit (e.g., a memory), or the like. The audible device 500 may be configured to include a variety of sensors. The sensors, for example, may include a biometric sensor (such as, an HRM (heart rate monitoring) sensor, a gyro sensor, a geomagnetic sensor, a GPS sensor, a body temperature detection sensor, a GSR (galvanic skin response) sensor, an ECG (electrocardiogram) sensor, or a PPG (photoplethysmogram) sensor).

The audible device 500 may include a housing (or a body) 550, and the housing 550, for example, may include a portion that is detachably mounted on the user's ear, a speaker, a battery, a wireless communication circuit, a memory, a processor, or the like.

The audible device 500 may be connected to the electronic device 400 (e.g., a mobile device, a smart phone, a tablet PC, etc.) by wireless communication. For example, in the case of wireless communication, the audible device 500 may process the audio signals (for example, applying an audio filter or amplifying the signal) received through an antenna, and may output sounds through the output unit. The audible device 500 may analyze the input audio signal, and if the input audio signal is determined to be a noise, the audible device 500 may eliminate the input audio signal. If no audio signal of more than a specific value is generated for a specific period of time, the audible device 500 may operate, at least in part, in the low power mode.

The audible device 500 may change the role of a master or a slave based on the connection with the electronic device 400 in order to reduce the battery consumption difference. The audible device 500 may perform the role conversion depending on the battery level, and may seamlessly perform the works through the exchange for the allocated works (e.g., the works requiring the current consumption of the audible device 500) upon the role conversion. The audible device 500 may seamlessly adjust the works between the first audible device 510 and the second audible device 520 in consideration of the battery level and the wearing state in order to thereby effectively operate the battery life and in order to thereby allow one audible device to process the works of the other audible device so that the usability may increase.

The audible device 500 may detect the battery level of each audible device, and may detect whether or not the user is wearing the corresponding audible device 500 by using various sensors (e.g., an HRM (heart rate monitoring) sensor, an acceleration sensor, etc). the audible device 500 may perform wireless communication between the first audible device 510 and the second audible device 520 based on wireless communication (e.g., Bluetooth communication, BLE communication, etc.), or one (e.g., a master) of the first audible device 510 or the second audible device 520 may communicate with the electronic device 400. The audible device 500 may seamlessly exchange the works between the first audible device 510 and the second audible device 520 by determining the battery level and the wearing state.

The work distribution of the audible device 500 may include the work distribution based on the battery ratio or the work distribution depending on the usage. For example, the work distribution of the audible device 500 may be performed in the case where the workload ratio can be adjusted to be closer (or approximate) to the battery ratio in the work distribution determination cycle or in the case where either of the audible devices cannot be used (e.g., taking-off or power-off). The workload may be expressed by the current consumption for the corresponding operation in the battery measurement cycle. When the work distribution determination cycle may be expressed by the time for which the battery 1 is consumed when the work having a minimum workload is independently executed on the assumption that the total amount of the battery is expressed to be 100. A work distribution method according to the battery ratio or the usage will be described in detail with reference to the drawings illustrated below.

The first audible device 510 and the second audible device 520 of the audible device 500 may be charged (e.g., wired charging or wireless charging) by interworking with the charging device 600. For example, when the audible device 500 is placed on the charging device 600, the audible device 500 may perform the charging operation based on the voltage supplied from the charging device 600. The audible device 500 may be applied with power, which is transmitted through an electrical circuit from the charging device 600, through an electrical circuit, and may charge the internal battery based on the applied power.

The audible device 500 may exchange information (e.g., power information) on the charging power (e.g., the charging voltage and the charging current) with the charging device 600 by using communication. For example, the audible device 500 and the charging device 600 may perform communication for the transmission and reception of information through each electrical circuit. Alternatively, the audible device 500 and the charging device 600 may perform communication for the transmission and reception of information through short-range communication (e.g., BLE, Zigbee, NFMI, NFC, etc.).

The audible device 500 may selectively receive at least one of a plurality of charging powers from the charging device 600. The audible device 500 may process the battery charging by using at least one charging power, which is selected. For example, the audible device 500 may receive the first charging power (e.g., a normal charging power) from the charging device 600, and may perform the charging to correspond to the first charging power, which has been received. The audible device 500 may make a request to the charging device 600 for the second charging power (e.g., a high-speed charging power) that is greater than the first charging power, which is used for the normal charging, through communication with the charging device 600. Accordingly, the audible device 500 may be supplied with power corresponding to the second charging power from the charging device 600. The audible device 500 may perform high-speed charging by using the second charging power supplied from the charging device 600. If the second charging power, which has been requested, is not supplied, the audible device 500 may perform the normal charging by using the power (e.g., the first charging power) supplied from the charging device 600.

The audible device 500 may include a PMIC, a charger IC, or the like. For example, the PMIC may be mounted in an integrated circuit or a SoC semiconductor. The PMIC may include a charger IC. The charge IC may include a charger IC for the wireless charging method. The wireless charging method, for example, may include an electromagnetic resonance method, a magnetic induction method, or an electromagnetic wave method, and additional circuits for the wireless charging (such as a coil loop, a resonance circuit, or a rectifier) may be added.

The audible device 500 may include a battery, and the battery may be charged through a separate charging device 600 (e.g., a battery charging dock or a cradle). The battery of the audible device 500 may be charged by directly receiving the output power of a power supply device (e.g., a travel adapter (TA) or a power supply).

The charging device 600 may include one or more batteries, and may include a charging circuit for charging the audible device 500 (e.g., the first audible device 510 or the second audible device 520). The charging device 600 may be configured to include a coil for wireless charging. When the direct current (DC) power is supplied from the power supply device (e.g., a travel adapter (TA) or a power supply), the charging device 600 may convert the DC power into the alternating current (AC) power, and may transmit the power to the audible device 500 through an electrical circuit (e.g., a charging terminal or a transmission coil for wireless charging). The power supply device may be integrally included in the charging device 600, or may be implemented to be a separate device (e.g., a charger).

The charging device 600 may include a housing (or a body) 650, and the housing 650, for example, may include a communication circuit, a power interface, a control circuit, a battery, and at least one coupling recess (e.g., a fixing member) that is configured to accept the audible device 500.

The charging device 600 may control the power supply device to supply the first voltage (e.g., a reference voltage of 5V) or the second voltage (e.g., a high voltage of 10V), which is greater than the first voltage (e.g., the reference voltage of 5V). For example, if the charging device 600 detects the connection of the power supply device, the charging device 600 may control the power supply device to output the first voltage, and thereafter, may control the power supply device to output the second voltage in response to a request of the audible device 500. The charging device 600 may control the power supply device to gradually change the maximum voltage to a low voltage to then be supplied. For example, when a connection of the power supply device is detected, the charging device 600 may control the power supply device to output the second voltage (e.g., the maximum voltage of 10V), and thereafter, may control the power supply device to output the third voltage (e.g., 7V), which is lower than the second voltage, in response to a request of the audible device 500. The third voltage may be greater than the first voltage and may be less than the second voltage. The charging device 600 may output the output power of the power supply device based on information (e.g., power information) related to the charging power (e.g., the charging voltage and the charging current) that is required by the audible device 500.

The charging device 600 may configure a high-speed charging mode or a normal charging mode depending on whether or not the power supply device supports the high-speed charging. The charging device 600 may receive a variety of information about the ID of the power supply device or the type thereof from the power supply device. The charging device 600 may determine whether or not the power supply device supports the high-speed charging mode by using the received information. If the power supply device supports the high-speed charging mode, the charging device 600 may configure the charging mode to be the high-speed charging mode.

The charging device 600 may receive a request for the second charging power greater than the first charging power through communication with the audible device 500. The charging device 600 may transfer the second charging power to the power supply device through communication with the power supply device, and may control the power supply device to supply the second charging power. For example, the charging device 600 may make a control to make a request to the power supply device for the output voltage that is greater than the normal charging power for the audible device 500 and to receive the output voltage that is greater than the normal charging power from the power supply device.

Figure 6:
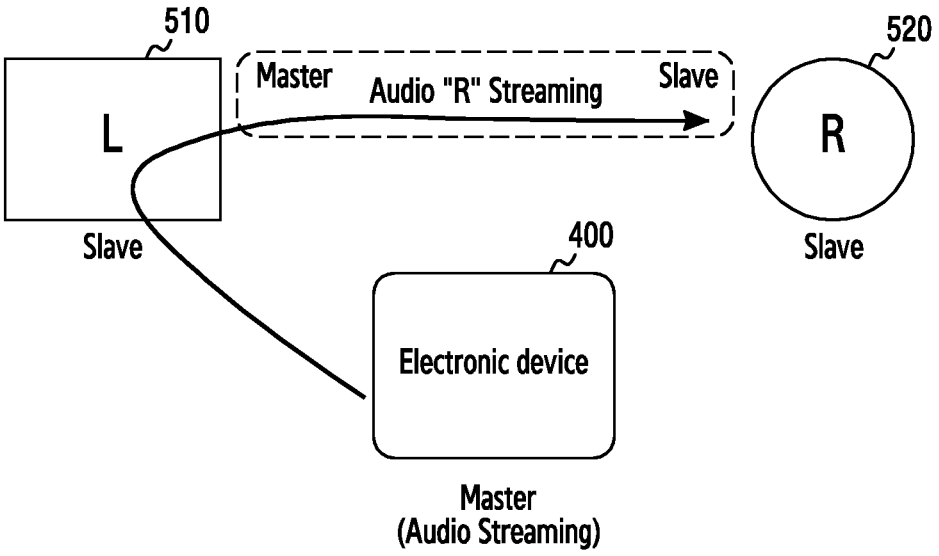
FIGS. 6 and 7 are diagrams illustrating an operation of changing the role of an audible device in the system, according to an embodiment of the present disclosure.
Figure 7:
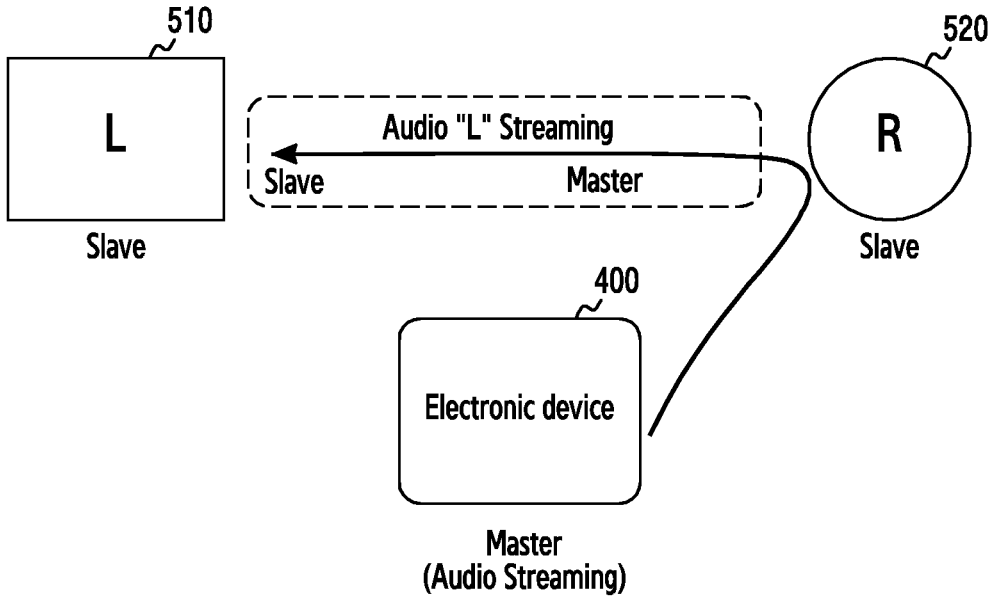

FIGS. 6 and 7 are diagrams illustrating an operation of changing the role of the audible device in the system, according to an embodiment of the present disclosure.

FIGS. 6 and 7 show an example of changing a host device of the audible device 500 (e.g., changing the role of a master or slave) depending on the state of the audible device 500 (e.g., the battery level or the wearing (usage) state) in the multi-pairing state between the electronic device 400 and the audible device 500 (e.g., the first audible device 510 or the second audible device 520). The change of the host device may be performed by the electronic device 400 or by the audible device 500 that operates as a master while being connected with the electronic device 400.

As shown in FIG. 6, the electronic device 400 may be connected with the first audible device 510, which operates as a master among the audible devices 500, and the first audible device 510 may be connected (paired) with the second audible device 520. The electronic device 400 may register and manage the first audible device 510 (e.g., the left earpiece (EP_L)) and the second audible device 520 (e.g., the right earpiece (EP_R)) as one audible device 500, and may connect to one audible device that operates as a master among the first audible device 510 or the second audible device 520. The first audible device 510 and the second audible device 520 may register and manage the counterpart device, respectively, and may configure the master or slave role between the first audible device 510 and the second audible device 520 through the signal transmission and reception therebetween. FIG. 6 shows an example in which the first audible device 510 operates as a master device with respect to the second audible device 520.

The electronic device 400 and the first audible device 510 may be connected with each other through the first wireless communication, and the first audible device 510 and the second audible device 520 may be connected with each other through the second wireless communication. The first wireless communication and the second wireless communication may be implemented by the same communication scheme, or by different communication schemes.

The electronic device 400 may operate as a mater device for the audio streaming between the electronic device 400 and the first audible device 510, and may transmit the audio streaming reproduced by the electronic device 400 to the first audible device 510.

The first audible device 510 may operate as a slave device for the electronic device 400, and may operate as a master device for the second audible device 520. The first audible device 510 may receive the audio streaming (e.g., the first audio streaming for the first audible device 510 or the second audio streaming for the second audible device 520) through the first wireless communication from the electronic device 400. The first audible device 510 may output the received audio streaming (e.g., the first audio streaming for the first audible device 510) through the speaker. In addition to the output of the audio streaming, the first audible device 510 may transmit the audio streaming (e.g., the second audio streaming for the second audible device 520) to the second audible device 520 through the second wireless communication.

The second audible device 520 may operate as a slave device for the first audible device 510. The second audible device 520 may receive the audio streaming (e.g., the second audio streaming for the second audible device 520) through the second wireless communication from the first audible device 510. The second audible device 520 may output the received audio streaming (e.g., the second audio streaming for the second audible device 520) through the speaker.

In the operating state as shown in FIG. 6, the first audible device 510 and the second audible device 520 may obtain state information (e.g., the battery level or the wearing (usage) state information) of the first audible device 510 and the second audible device 520 through a periodic negotiation while they are connected with each other. If the first audible device 510 is connected with the electronic device 400, the second audible device 520, which relatively operates as a slave, may provide the battery state (e.g., the battery level). In the case where the first audible device 510 and the second audible device 520 are not connected with the electronic device 400, the audible device of which the battery level is relatively high (e.g., the remaining amount of battery is relatively great) among the first audible device 510 and the second audible device 520 may provide the battery level. For example, in the case where one of the audible devices 500 is connected with the electronic device 400, the master audible device may take the lead in the work distribution. Therefore, it may be advantageous for the master audible device to receive the battery state from the slave audible device. As another example, in the case where the audible device 500 is not connected with the electronic device 400, the audible device, which has the greater battery level, may play the role of transferring the battery state.

The audible device 500 may identify the first state information of the first audible device 510 and the second state information of the second audible device 520 in order to thereby change the role of a master between the first audible device 510 and the second audible device 520. For example, if the first battery level of the first audible device 510 is greater than the second battery level of the second audible device 520 while both the first audible device 510 and the second audible device 520 are worn on the ears, the first audible device 510 having the first battery level may be determined to be a master device in order to thereby maintain the role of a master. As another example, if the first battery level of the first audible device 510 is less than the second battery level of the second audible device 520 while both the first audible device 510 and the second audible device 520 are worn on the ears, the second audible device 520 may be determined to be a master device in order to thereby change the role of a master/slave. As another example, if the first audible device 510 is worn but the second audible device 520 is not worn, or if the battery level of the second audible device 520 is equal to, or less than, a specific level (or the power is expected to be turned off), the first audible device 510 may remain to be the role of a master, and may further perform the works that are allocated to the second audible device 520. As another example, if the second audible device 520 is worn but the first audible device 510 is not worn, or if the battery level of the first audible device 510 is equal to, or less than, a specific level (or the power is expected to be turned off), the role of a master may be changed such that the second audible device 520 is determined to be a master device and the works, which have been allocated to the first audible device 510, may be distributed to the second audible device 520.

In the operating state as shown in FIG. 6, the electronic device 400 may obtain state information of the first audible device 510 and the second audible device 520 through a periodic negotiation with the first audible device 510, which is connected thereto. The electronic device 400 may control the role change of the audible device 500 depending on the aforementioned state of the audible device 500. The electronic device 400 may obtain the battery level of the first audible device 510 (hereinafter, the first battery level) and the battery level of the second audible device 520 (hereinafter, the second battery level) from the first audible device 510, which is connected thereto. The electronic device 400 may compare the first battery level with the second battery level in order to thereby determine a master device between the first audible device 510 and the second audible device 520.

If the first battery level is higher than the second battery level, the electronic device 400 may determine the first audible device 510 having the first battery level to be a master device, and may maintain the connection with the first audible device 510. If the second battery level is higher than the first battery level, the electronic device 400 may determine the second audible device 520 of the second battery level to be a master device, and may determine to change the connection of the audible device 500. The electronic device 400 may process the operation that is related to the execution of a connection with the second audible device 520. For example, the electronic device 400 may process a signal communication operation for a connection (e.g., pairing) with the second audible device 520 based on the first wireless communication. The electronic device 400 may provide a control signal that allows the second audible device 520 to operate as a master in the signal communication operation. When the electronic device 400 switches the connection from the first audible device 510 to the second audible device 520, the electronic device 400 may perform an operation of releasing the connection with the first audible device 510. The electronic device 400 may instruct to configure a connection with the second audible device 520 through the first audible device 510, and may process an intermediate operation (or a relay operation) in order for the first audible device 510 to configure a connection between the electronic device 400 and the second audible device 520 (for example, an operation of transferring a control signal of the electronic device 400).

In the operating state as shown in FIG. 6, the first audible device 510, which operates as a master device, may periodically detect the battery level of the first audible device 510 (hereafter, the first battery level), and may obtain the battery level of the second audible device 520 (hereinafter, the second battery level) through a periodic negotiation with the first audible device 510, which is connected thereto. The first audible device 510 may compare the first battery level with the second battery level in order to thereby determine a master device between the first audible device 510 and the second audible device 520.

If the first battery level is higher than the second battery level, the first audible device 510 may be determined to be a master device so that the current role thereof may be maintained. The first audible device 510 may provide the electronic device 400 with information on the determination of the master device.

If the second battery level is higher than the first battery level, the first audible device 510 may determine the second audible device 520 to be a master device, and may determine the role change (for example, a master→a slave). The first audible device 510 may process the operations that are related to the role change from the master device to the slave device. For example, the first audible device 510 may process the signal communication operation to allow the second audible device 520 to operate as a master device based on the second wireless communication. The first audible device 510 may provide information to allow the second audible device 520 to configure communication with the first audible device 510 based on the first wireless communication in the signal communication operation with the second audible device 520. The first audible device 510 may control the second audible device 520 to operate as a master and may perform an operation of releasing the connection with the electronic device 400 when changing the role thereof. The first audible device 510 may provide information to allow the electronic device 400 to configure a connection with the second audible device 520 through the first wireless communication.

In addition to the role change, the first audible device 510 and the second audible device 520 may exchange, or redistribute, the works, which have been allocated (distributed) to the respective audible devices 510 and 520. For example, Work 1 that has been allocated to the first audible device 510 may be distributed to the second audible device 520 in order for the second audible device 520 to perform the operation related thereto, and Work 2 that has been allocated to the second audible device 520 may be distributed to the first audible device 510 in order for the first audible device 510 to perform the operation related thereto. The dynamic work distribution, will be described in detail with reference to the drawings illustrated below.

In the operating state as shown in FIG. 6, if the battery level of the first audible device 510 becomes lower than a specific reference, the first audible device 510, which operates as a master device, may expect that the power of the first audible device 510 will be turned off. In the case where the power-off is expected, the first audible device 510 may change the role of a master between the first audible device 510 and the second audible device 520. For example, the first audible device 510 may process an operation that is related to the change in the role of the second audible device 520 from a slave device to a master device. In addition to the role change, the first audible device 510 may process an operation that allows the second audible device 520 to perform the work, which has been allocated to the first audible device 510, and the context related thereto.

In the operating state as shown in FIG. 6, the first audible device 510, which operates as a master device, may detect the taking-off (e.g. shutting down) of the first audible device 510. If the taking-off of the first audible device 510 is detected, the first audible device 510 may change the role of a master between the first audible device 510 and the second audible device 520. For example, the first audible device 510 may process an operation that is related to the change in the role of the second audible device 520 from a slave device to a master device. In addition to the role change, the first audible device 510 may process an operation that allows the second audible device 520 to perform the works, which have been allocated to the first audible device 510, and the context related thereto.

The connection state of the electronic device 400 and the audible device 500, according to the aforementioned operation, is illustrated in FIG. 7.

As shown in FIG. 7, the electronic device 400 may disconnect from the first audible device 510, and may connect to the second audible device 520, which is configured to be a master device, through the first wireless communication. The first audible device 510 and the second audible device 520 may be connected with each other through the second wireless communication.

FIG. 7 shows the state in which the roles of a master and a slave of the first audible device 510 and the second audible device 520 have been changed. In this case, the second audible device 520 may receive the audio streaming (e.g., the first audio streaming or the second audio streaming) from the electronic device 400 through the first wireless communication. The second audible device 520 may output the received audio streaming (e.g., the second audio streaming) through the speaker, and, in addition to the output of the second audio streaming, may transmit the audio streaming (e.g., the first audio streaming) to the first audible device 510 through the second wireless communication.

In addition to the role change, the first audible device 510 and the second audible device 520 may exchange, or redistribute, the works, which have been allocated (distributed) to the respective audible devices 510 and 520. For example, when the role of the first audible device 510 is changed due to taking-off or the expectation of power-off, Work 1, which has been allocated to the first audible device 510, may be distributed to the second audible device 520 in order for the second audible device 520 to perform the operations related thereto. The second audible device 520 may operate to process Work 1 as well as previously allocated Work 2. The dynamic work distribution, according to various embodiments, will be described in detail with reference to the drawings illustrated below.

According to various embodiments, the dynamic work distribution may be performed by the audible device 500 or by the electronic device 400.

Figure 8:
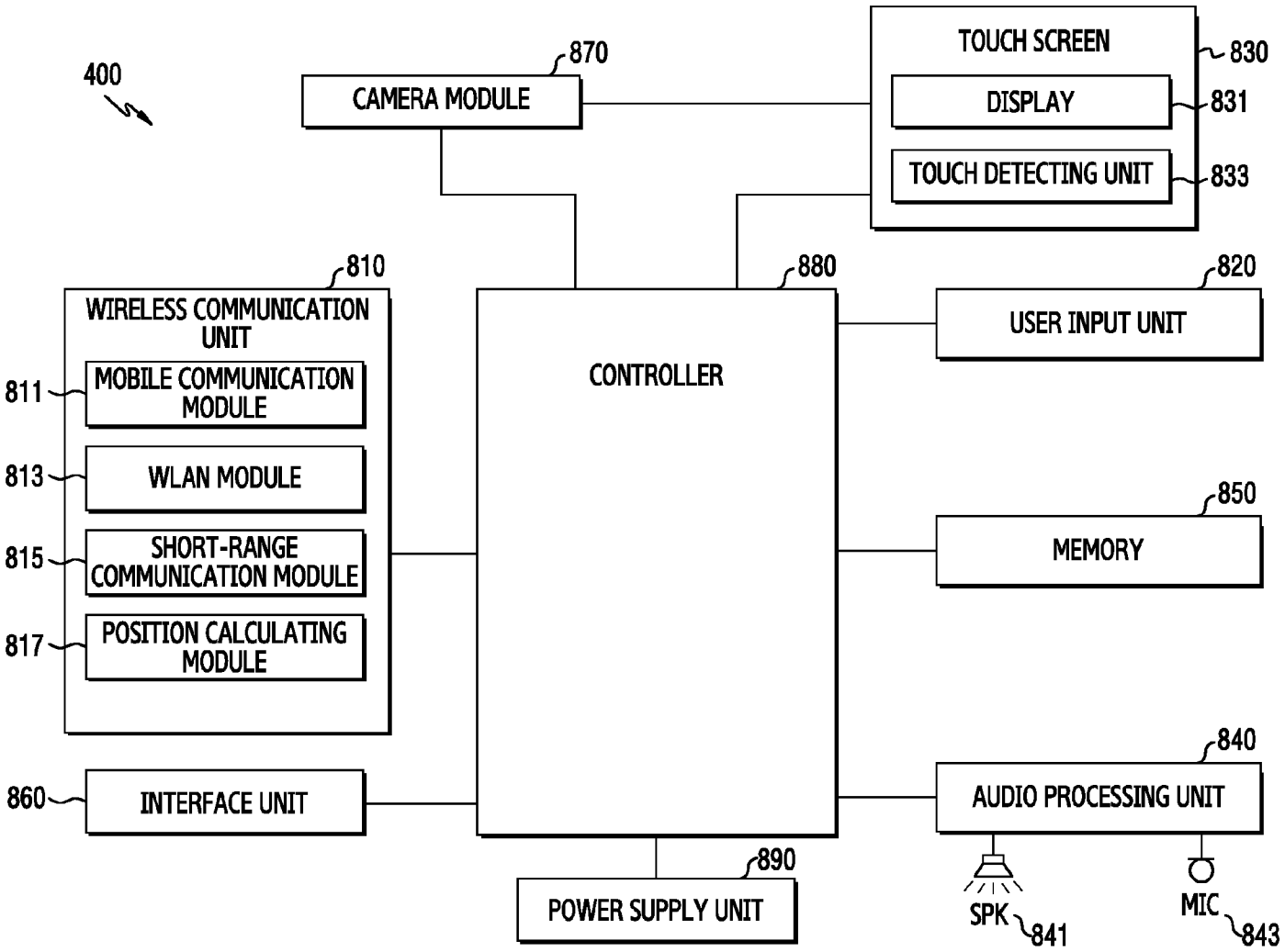
FIG. 8 is a diagram illustrating the configuration of an electronic device, according to an embodiment of the present disclosure.

FIG. 8 is a diagram illustrating an electronic device, according to an embodiment of the present disclosure.

Referring to FIG. 8, the electronic device 400 may include, for example, a wireless communication unit 810, a user input unit 820, a touch screen 830, an audio processing unit 840, a memory 850, an interface unit 860, a camera module 870, a controller 880), and a power supply unit 890. The elements shown in FIG. 8 are not essential, so the electronic device 400 may be implemented to have more, or fewer, elements, than the elements shown in FIG. 8.

The wireless communication unit 810, for example, may have the same, or a similar, configuration as the communication module 220 of FIG. 2. The wireless communication unit 810 may include one or more modules that enable wireless communication between the electronic device 400 and external electronic devices (e.g., the audible device 500 or the server 106). For example, the wireless communication unit 810 may be configured to include a mobile communication module 811, a WLAN module 813, a short-range communication module 815, and a position calculating module 817. The wireless communication unit 810 may include a module (e.g., a short-range communication module, a telecommunication module, or the like) for performing communication with the external electronic devices around the wireless communication unit 810.

The mobile communication module 811, for example, may have the same, or a similar, configuration as the cellular module 221 of FIG. 2. The mobile communication module 811 may transmit/receive wireless signals to/from at least one of: a base station in the mobile communication network; the external electronic devices (e.g., the audible device 500 or the other electronic device 104); or various servers (e.g., an application server, a management server, an integration server, a provider server, a content server, an Internet server, or a cloud server). The wireless signals may include voice signals, data signals, or various types of control signals. The mobile communication module 811 may transmit a variety of data that is necessary for the operation of the electronic device 400 to the audible device 500, the server 106, or the other electronic device 104 in response to a user's request.

The wireless LAN module 813, for example, may have the same, or a similar, configuration as the WiFi module 223 of FIG. 2. The wireless LAN module 813 may refer to a module for wireless internet access and for forming a wireless LAN link with the audible device 500, the other electronic device 102, or the server 106. The wireless LAN module 813 may be provided inside, or outside, the electronic device 400. The wireless internet technology may use WiFi, Wibro, WiMax (world interoperability for microwave access), high speed downlink packet access (HSDPA), or millimeter wave (mmWave). The wireless LAN module 813 may interwork with the audible device 500 or the electronic device 104, which are connected with the electronic device 400 through the network 162 in order to thereby transmit a variety of data from the electronic device 400 to the audible device 500, or in order to thereby receive data from the outside. The wireless LAN module 813 may always remain in the on state, or may be turned on/off according to the configuration of the electronic device 400 or a user input.

The short-range communication module 815 may refer to a module for performing the short-range communication. The short-range communication technology may use Bluetooth, BLE, radio frequency identification (RFID), infrared data association (IrDA), ultra wideband (UWB), ZigBee, near-field magnetic induction (NFMI), or NFC. The short-range communication module 815 may interwork with the audible device 500, which can be connected with the electronic device 400 through a network (e.g., a short-range communication network) in order to thereby transmit a variety of data from the electronic device 400 to the external electronic devices, or in order to thereby receive data from the same. The short-range communication module 815 may always remain in the on state, or may be turned on/off according to the configuration of the electronic device 400 or a user input.

The position calculating module 817, for example, may have the same, or a similar, configuration as the GNSS module 227 of FIG. 2. The position calculating module 817 is intended to obtain the position of the electronic device 400, and may include a GPS module as a typical example. The position calculating module 817 may measure the position of the electronic device 400 according to the principle of triangulation.

The user input unit 820 may create input data for controlling the operation of the electronic device 400 in response to a user input. The user input unit 820 may include one or more input devices for detecting various inputs from the user. For example, the user input unit 820 may include a keypad, a dome switch, physical buttons, a touch pad (pressure-sensitive type/capacitive type), a jog & shuttle, and sensors (e.g., the sensor module 240).

Some of the user input unit 820 may be implemented in the form of a button on the outside of the electronic device 400, or some or all of the user input unit 820 may be implemented as a touch panel. The user input unit 820 may receive a user input for initiating the operation of the electronic device 400 (e.g., an audio reproduction function, a connection function of the audible device 500, or the like), and may create an input signal in response to the user input.

The touch screen 830 may refer to an input/output device that can perform both the input function and the display function, and may include a display 831 and a touch detecting unit 833. The touch screen 830 may: provide an input/output interface between the electronic device 400 and a user; transmit a user's touch input to the electronic device 400; and serve as a medium for displaying an output of the electronic device 400 to the user. The touch screen 830 may display a visual output to the user. The visual output may be made in the form of text, a graphic, a video, or a combination thereof.

The display 831 may display (output) a variety of information that is processed in the electronic device 400. For example, the display 831 may display a user interface (UI) or a GUI that is related to an operation of: connecting to the audible device 500 by the electronic device 400; displaying the state information (e.g., the battery level or the wearing state) of the audible device 500; or reproducing audio files. The display 831 may adopt various displays (e.g., the display 160). A bent display may be used for the display 831.

The touch detecting unit 833 may be placed on the display 831, and may detect a user input made by a touch or proximity with respect to the surface of the touch screen 830. The user input may include a touch input or a proximity input, which is made based on at least one of a single-touch, a multi-touch, hovering, or an air gesture. The touch detecting unit 833, in various embodiments, may receive a user input for initiating an operation related to the usage of the electronic device 400, and may generate an input signal in response to the user input.

The audio processing unit 840, for example, may have the same, or a similar, configuration as the audio module 280 of FIG. 2. The audio processing unit 840 may perform a function of transmitting an audio signal received from the controller 880 to a speaker (SPK) 841, and a function of transmitting, to the controller 880, an audio signal, such as a voice, which is input from a microphone (MIC) 843. The audio processing unit 840 may convert voice/sound data into audible sounds in order to thereby output the same to the speaker 841 according to the control of the controller 880, and may convert audio signals, such as a voice, which are received from the microphone 843, into digital signals in order to thereby transmit the same to the controller 880.

The speaker 841 may output audio data, which is received from the wireless communication unit 810 or is stored in the memory 850. The speaker 841 may output sound signals in relation to various operations (functions), which are performed by the electronic device 400.

The microphone 843 may receive external sound signals, and may convert the same to electrical sound data. The microphone 843 may have a variety of noise reduction algorithms to remove noise generated in the course of receiving the external sound signals. The microphone 843 may play the role of inputting the audio streaming, such as a voice instruction (for example, a voice instruction to initiate a function of: selecting the audible device 500; connecting to the audible device 500; or reproducing audio data).

The memory 850 may store one or more programs that are executed by the controller 880, and may perform a function of temporarily storing the input/output data. The input/output data, for example, may contain files (such as moving images, images, pictures, or audio files) and state information of the audible device 500. The memory 850 may play the role of storing obtained data. The data that is obtained in real time may be stored in a temporary storage device, and the data that is determined to be stored may be stored in a permanent storage device.

The memory 850 may store one or more programs, data, or instructions that are related to the operation in which the controller 880: establishes a connection with one of the first audible device 510 or the second audible device 520 by using the wireless communication unit 810; receives, from the one connected audible device, the first data related to the first audible device 510 and the second data related to the second audible device 520 by using the wireless communication circuit; and controls the operation (e.g., the role conversion or the work distribution) of at least one of the first audible device 510 or the second audible device 520 based on at least some of the first data or the second data.

The memory 850 may include one or more application modules (or software modules).

The interface unit 860, for example, may have the same, or a similar, configuration as the interface 270 of FIG. 2. The interface unit 860 may receive data or power from other electronic devices in order to thereby transmit the same to the elements in the electronic device 400. The interface unit 860 may allow data in the electronic device 400 to be transmitted to other electronic devices. For example, the interface unit 860 may include a wired/wireless headset port, an external charger port, a wired/wireless data port, a memory card port, an audio input/output port, a moving image input/output port, an earphone port, or the like.

The camera module 870 may support a photographing function of the electronic device 400. The camera module 870 may photograph a certain subject in order to thereby transmit the photographed data (e.g., images) to the display 831 and the controller 880 under the control of the controller 880.

The controller 880 may control the overall operations of the electronic device 400. The controller 880, for example, may have the same, or a similar, configuration as the processor 210 of FIG. 2.

The controller 880 may process operations of: establishing a connection with one of the first audible device 510 or the second audible device 520 by using the wireless communication unit 810; receiving, from the one connected audible device, the first data related to the first audible device 510 and the second data related to the second audible device 520 by using the wireless communication circuit; and controlling the operation (e.g., the role conversion or the work distribution) of at least one of the first audible device 510 or the second audible device 520 based on at least some of the first data or the second data.

The controller 880 may process operations of: obtaining the battery ratio between the first audible device 510 and the second audible device 520 based on at least some of the first data or the second data; comparing the obtained battery ratio with a plurality of reference ratios (e.g., workload ratios); determining a reference ratio that is close to the battery ratio among the plurality of reference ratios based on at least some of the comparison; and controlling the operation of at least one of the first audible device 510 or the second audible device 520.

The first audible device 510 and the second audible device 520 may store the first data and the second data, respectively, and the first data and the second data may be provided to the electronic device 400 through at least one audible device that is connected to the electronic device 400. The controller 880 may: collect the first data of the first audible device 510 and the second data of the second audible device 520; analyze (calculate) the states of the audible devices based on at least some of the first data and the second data; and dynamically distribute the works of the audible devices based on the result thereof. When other audible devices including new functions are connected, the controller 880 may update a table related to the work distribution in response to the other audible devices and/or the new functions, and may dynamically distribute the works of the other audible devices based on the same.

The controller 880 may include one or more processors for controlling the operation of the electronic device 400. The controller 880 may control the operation of hardware modules, such as the audio processing unit 840, the interface unit 860, the display 831, or the camera module 870. The control operation of the controller 880 will be described in detail with reference to the drawings illustrated below. The controller 880 may be implemented by one or more processors that control the operation of the electronic device 400 by executing one or more programs, which are stored in the memory 850.

The power supply unit 890 may receive power from the external power source or internal power source in order to thereby supply the power that is necessary for the operation of the elements under the control of the controller 880. The power supply unit 890 may supply power to the wireless communication unit 810, the display 831, or the camera module 870, or may cut off the supply of power thereto under the control of the controller 880.

As described above, an electronic device 400, may include: the wireless communication unit 810 that is configured to communicate with the audible device 500 by wireless communication; and the controller 880 that is configured to be electrically connected with the wireless communication circuit, wherein the processor is configured to: establish a connection with one of the first audible device 510 or the second audible device 520 by using the wireless communication circuit; receive the first data related to the first audible device 510 and the second data related to the second audible device 520 from the one connected audible device by using the wireless communication circuit; and control the operation (e.g., the role conversion or the work distribution) of at least one of the first audible device 510 or the second audible device 520 based on at least some of the first data or the second data.

The processor may be configured to control the operation such that the first audible device 510 operates as a master device and the second audible device 520 operates as a slave device, or such that the second audible device 520 operates as a master device and the first audible device 510 operates as a slave device.

The processor may be configured to control the operation of at least one of the role conversion or the work redistribution of the first audible device 510 or the second audible device 520 based on at least some of the first data of the first audible device 510 and the second data of the second audible device 520.

The data may contain at least one of the battery level or the wearing state information.

The processor may be configured to: obtain the battery ratio between the first audible device 510 and the second audible device 520 based on at least some of the first data and the second data; compare the obtained battery ratio with a plurality of reference ratios; determine a reference ratio that is close to the battery ratio among the plurality of reference ratios based on at least some of the comparison; and control the operation of at least one of the first audible device 510 or the second audible device 520 based on at least some of the determination.

The reference ratio may include the workload ratio of the first audible device 510 and the second audible device 520.

Figure 9:
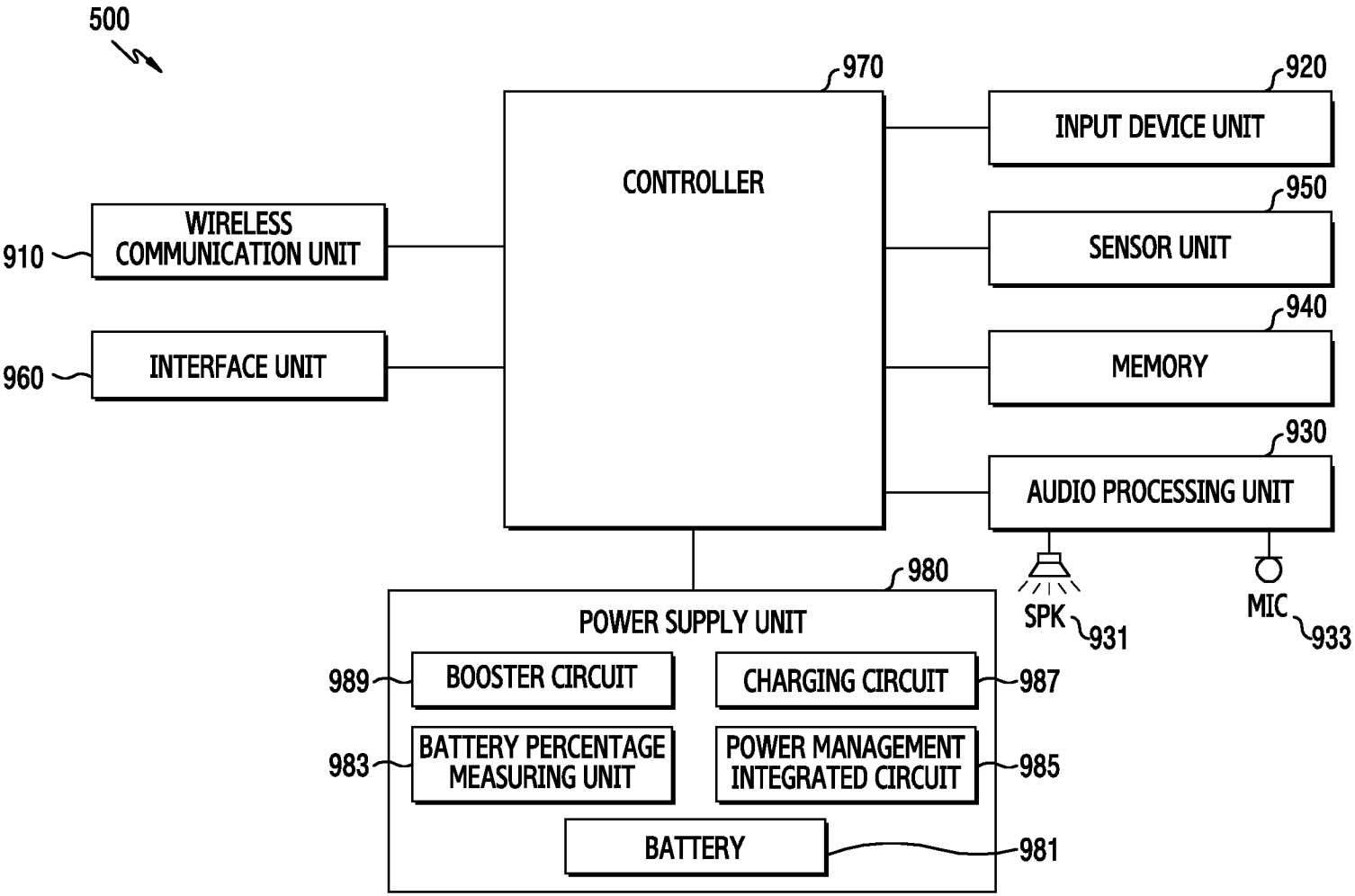
FIG. 9 is a diagram illustrating the configuration of an audible device, according to an embodiment of the present disclosure.

FIG. 9 is a diagram illustrating the audible device, according to an embodiment of the present disclosure.

Referring to FIG. 9, the audible device 500 may include a wireless communication unit 910, an input device unit 920, an audio processing unit 930, a memory 940, a sensor unit 950, an interface unit 960, a controller 970, and a power supply unit 980, and the audible device 500 may have the same, or a similar, configuration as the electronic device 400 of FIG. 8 described above. In various embodiments, the elements shown in FIG. 9 are not essential, so the audible device 500 may be implemented to have more, or fewer, elements than the elements shown in FIG. 9.

The wireless communication unit 910 may include one or more modules that enable wireless communication between the audible device 500 and the electronic device 400. For example, the wireless communication unit 910 may be configured to include a short-range communication module, and may further include communication modules corresponding to the wireless communication unit 810 of FIG. 8. In various embodiments, the wireless communication unit 910 may include a module (e.g., a short-range communication module, a telecommunication module, or the like) for performing communication with the external electronic devices around the same. The configuration of the wireless communication unit 910 may correspond to the configuration of the wireless communication unit 810, which has been explained in the description of FIG. 8 above, so the detailed description thereof will be omitted.

The input device unit 920 may create input data for controlling the operation of the audible device 500 in response to a user input. The configuration of the input device unit 920 may correspond to the configuration of the user input unit 820, which has been explained in the description of FIG. 8 above, so the detailed description thereof will be omitted.

The audio processing unit 930 may perform functions of: transmitting an audio signal, which is received from other external electronic devices (e.g., the electronic device 400) through the wireless communication unit 910, to a speaker (SPK) 931; and transferring, to the controller 970, an audio signal, such as a voice, which is input from a microphone (MIC) 933 under the control of the controller 970. The configuration of the audio processing unit 930 may correspond to the configuration of the audio processing unit 940, which has been explained in the description of FIG. 8 above, so the detailed description thereof will be omitted.

The memory 940 may store one or more programs that are executed by the controller 970, and may perform a function of temporarily storing the input/output data. The input/output data, for example, may contain the audio streaming, voice instructions, mode configuration information, state information, or the like. The memory 940 may play the role of storing obtained data. The data that is obtained in real time may be stored in a temporary storage device, and the data that is determined to be stored may be stored in a permanent storage device.

The memory 940 may store one or more programs, data, or instructions that are related to the operation in which the controller 970: establishes a connection with the second audible device 520 by using the wireless communication unit 910; receives the second battery level of the second audible device 520 by using the wireless communication circuit; obtains the battery ratio between the first battery level of the first audible device 510 and the second battery level; compares the battery level with at least one of a plurality of reference ratios (e.g., workload ratios); and controls the operation (e.g., the role conversion or the work distribution) of at least one of the first audible device 510 or the second audible device 520 based on at least some of the comparison.

The memory 940 may include one or more application modules (or software modules).

The sensor unit 950 may have the same, or a similar, configuration as the sensor module 240 of FIG. 2. The sensor unit 950 may detect the movement and position of the audible device 500, and may provide the controller 970 with sensed information according to the detection result. The sensor unit 950 may include one or more sensors that can detect whether or not the audible device 500 is worn on the user's body and can create data to be used to determine the wearing state or the non-wearing state. The sensor, for example, may include at least one of an HRM sensor, a proximity sensor, a biometric sensor, a body temperature detection sensor, a GSR sensor, an ECG sensor, a PPG sensor, a gyro sensor, an acceleration sensor, an angular velocity sensor, a GPS sensor, a voice recognition sensor, a wind (noise) measurement sensor, or a rotation recognition sensor. The audible device 500 may identify whether or not the audible device 500 is worn on the user through the sensor unit 950. The audible device 500 may determine whether or not the audible device 500 is worn on the user in order to thereby configure the power control mode of the audible device 500. In the case of an acceleration sensor, the audible device 500 may detect the motion of the user through the acceleration sensor, and if no specific motion is detected, the audible device 500 may operate in the sleep mode. In the case of an HRM sensor, the audible device 500 may identify whether or not the user's heart rate is detected through the user's ears, and if no heart rate is detected, the audible device 500 may operate in the sleep mode.

The interface unit 960 may have the same, or a similar, configuration as the interface 270 of FIG. 2. The interface unit 960 may receive data or power from other external electronic devices in order to thereby transfer the same to the elements in the audible device 500. The interface unit 960 may allow data in the audible device 500 to be transmitted to the electronic device 400. The configuration of the interface unit 960 may correspond to the configuration of the interface unit 860, which has been explained in the description of FIG. 8 above.

The controller 970 may control the overall operations of the audible device 500. The controller 970 may have the same, or a similar, configuration as the processor 210 of FIG. 2.

The controller 970 may process operations of: establishing a connection with the second audible device 520 by using the wireless communication unit 910; receiving the second battery level of the second audible device 520 by using the wireless communication circuit; obtaining the battery ratio between the first battery level of the first audible device 510 and the second battery level; comparing the battery level with at least one of a plurality of reference ratios (e.g., workload ratios); and controlling the operation (e.g., the role conversion or the work distribution) of at least one of the first audible device 510 or the second audible device 520 based on at least some of the comparison.

The controller 970 may include one or more processors for controlling the operation of the audible device 500. The controller 970 may control the operation of hardware modules, such as wireless communication unit 910, the audio processing unit 930, the sensor unit 950, or the interface unit 960. The control operation of the controller 970 will be described in detail with reference to the drawings illustrated below. The controller 970 may be implemented by one or more processors that control the operation of the audible device 500 by executing one or more programs, which are stored in the memory 940.

The power supply unit 980 may receive power from an external power source or internal power source in order to thereby supply the power that is necessary for the operation of the elements under the control of the controller 970. The power supply unit 980 may supply power to the wireless communication unit 910, the sensor unit 950, or the audio processing unit 930, or may cut off the supply of power thereto under the control of the controller 970.

The power supply unit 980, for example, may include a battery control circuit. For example, the power supply unit 980 may be configured to include a battery 981, a battery percentage measuring unit 983, a power management integrated circuit 985, a charging circuit 987, and a booster circuit 989.

The battery 981 may be functionally, or physically, connected to the audible device 500 through various interfaces. For example, the battery 981 may include a rechargeable battery and/or a solar cell.

The battery percentage measuring unit 983 (for example, a battery gauge) may measure information on the battery 981. The information on the battery 981 may contain the remaining amount, a charging voltage, current, or temperature of the battery 981. The battery percentage measuring unit 983 may measure the information on the battery 981 based on a signal that is received through an electrical path connected to the battery 981. The battery percentage measuring unit 983 may provide the measured information on the battery 981 to the controller 970.

The PMIC 985 may manage the power of the audible device 500. The PMIC 985 may include a wired and/or wireless charging system. The wireless charging system, for example, may use a magnetic resonance method, a magnetic induction method, or an electromagnetic radiation method, and may further include additional circuits (such as a coil loop, a resonance circuit, or a rectifier) for wireless charging.

The charging circuit 987 may provide the voltage, which is applied through the booster circuit 989 or an external device (e.g., a charger), to at least one of the power management integrated circuit 985 or the battery 981.

The booster circuit 989 may be connected to the battery 981 in order to thereby boost the voltage of the connected battery 981 to then provide the same to the charging circuit 987.

The audible device 500 may communicate with the electronic device 400, which may be a smart phone or a tablet PC. The audible device 500 may be paired with other electronic devices through wireless communication (e.g., RF, NFMI, BT, BLE, or the like). For example, the audible device 500 may receive, from the connected electronic device 400, a music reproduction signal, a call reception signal, an alarm signal, or microphone input signals of the electronic device 400, and may output the same as sound information.

The audible device 500 may change the configuration state of the audible device 500 through the other electronic devices. The auditory device 500 may be small and may not have a separate display device. Furthermore, the audible device 500 is comprised of a limited input unit (e.g., buttons). For example, when configuring the mode or volume through the input unit of the audible device 500, it may be inconvenient to check the configuration state and to configure a desired mode. For example, when the volume level is changed from 3 to 2 by using a button, the button may be pressed five times (for example, 3→4→5→1→2). Various modes of the audible device 500 may be conveniently configured when it is configured in association with the other electronic device. For example, in the case of using an electronic device 400 that includes a variety of input units (e.g., touch keys or buttons) and a display device, a UI may be provided to the user through the electronic device 400 so that the user may easily change the configuration of the audible device 500 according to the provided UI. The mode may be configured through a touch input (for example, a one-time touch input) when adjusting the volume.

For example, the audible device 500 may communicate with the electronic device 400 in order to thereby process the control and change of the configuration of the audible device 500. A configuration application related to the audible device 500 may be provided to the electronic device 400, and the mode control and volume control of the audible device 500 may be processed through the configuration application. The user may display modes that can be configured in the audible device 500 through a display of the electronic device 400, and may configure a desired mode through an input device (e.g., a touch screen) of the electronic device 400. The volume of the audible device 500 may be adjusted through an input unit (e.g., a volume key) of the electronic device 400. In addition, the mode of the audible device 500 may be configured through various sensors (e.g., an acceleration sensor, a gyro sensor, a biometric sensor, a proximity sensor, or the like) of the electronic device 400 that is connected with the audible device 500. The configured mode of the audible device 500 may be changed by rocking the electronic device 400 left and right, or up and down.

The audible device 500 may be connected to the electronic device 400 in order to thereby output the sound of a remote place clearly. For example, the user may reproduce and listen to sound sources that are recorded in the electronic device 400 through the audible device 500. If the input unit (e.g., a microphone) of the electronic device 400 is configured to be a remote microphone, the audible device 500 may receive microphone audio signals of the electronic device 400. The microphone audio signals, which are received from the electronic device 400, may be processed to the compressed data through a data compression operation, and the compressed data may be transmitted to the audible device through the wireless communication unit of the electronic device 400. The audible device 500 may: receive the data through the wireless communication unit of the audible device 500; separate audio information that is contained in the data format; and reproduce the same through an audio information decompression operation to then be output to a receiver.

The audible device 500 may receive audio signals that are stored in the electronic device 400 in order to thereby reproduce the same. The electronic device 400 may store a number of alarm sounds. For example, the electronic device 400 may transmit, to the audible device 500, different alarm sounds depending on the user's situation, the state of a system, time, reception or non-reception of a message, or reception or non-reception of an e-mail to then be reproduced. The audible device 500 may separate audio information, which is contained in the data format, from the data that is transmitted from the electronic device 400, and may reproduce the same through the audio information decompression operation to then be output to the receiver.

The audible device 500 may record signals by using the electronic device 400. For example, the audio data may be stored after being compressed for effective use of the electronic device 400. The electronic device 400 may convert the audio signal, which is received from the audible device 500, into text information by using speech-to-text (STT) technology to then be stored. The electronic device 400 may store text corresponding to a conversation, voice mails of the user, or the content of broadcast by using the STT method. The electronic device 400 may add and store a variety of information, such as time information, sensor information, or location information when storing text corresponding to a conversation, voice mails of the user, or the content of broadcast. The conversation stored in the electronic device 400 may be viewed by using the display of the electronic device 400. Alternatively, the electronic device 400 may convert the text information into audio signals by using text-to-speech (TTS) technology to then be transmitted to the receiver of the audible device 500.

The audible device 500 may transmit signals that are received through the microphone, which is provided in the audible device 500, to the electronic device 400, and the electronic device 400 may store the received signals. In order to reduce the power consumption for transmitting the signals received through the microphone of the audible device 500 to the electronic device 400, the data signals may be compressed, and then the compressed signals may be transmitted. The audible device 500 may include a codec for compressing, or decompressing, the audio data. The signal received through the microphone of the audible device 500 may be transmitted to the electronic device 400, and may be converted into text information through the STT technology to then be stored. The stored text may be output through the speaker of the electronic device 400.

The audible device 500 and the electronic device 400 may be used as a communication means between remote places by using the microphone and the receiver.

Figure 10:
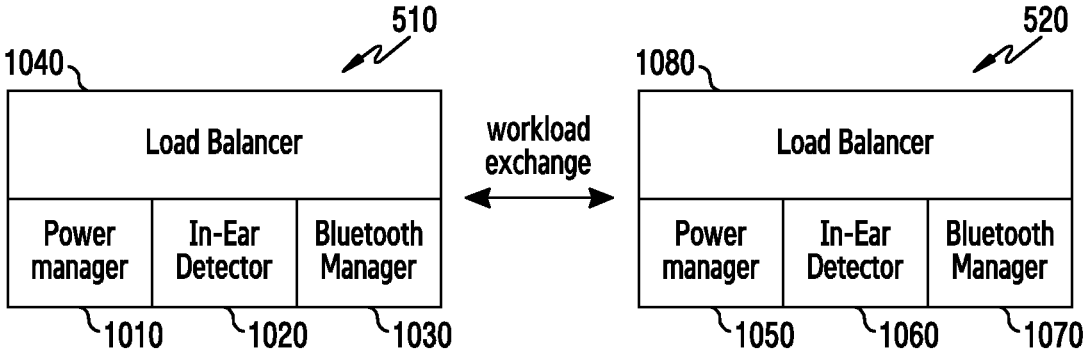
FIG. 10 is a diagram illustrating a program module of the audible device, according to an embodiment of the present disclosure.

FIG. 10 is a diagram illustrating a program module of the audible device, according to an embodiment of the present disclosure.

As shown in FIG. 10, the audible device 500 may symmetrically include software modules or hardware for work exchange between the first audible device 510 and the second audible device 520.

Referring to FIG. 10, a power manager 1010 or 1050 provides an interface to check the battery level of the corresponding to audible device 510 or 520.

An in-ear detector 1020 or 1060 provides an interface to identify whether or not the user wears the corresponding audible device 510 or 520 by using, for example, the HRM sensor and the acceleration sensor.

The Bluetooth manager 1030 or 1070 may perform the communication between the first audible device 510 and the second audible device 520, and/or the communication with the electronic device 400.

The load balancer 1040 or 1080, for example, may determine criteria, such as the battery level or the wearing state, in relation to the corresponding audible device 510 or 520 based on at least some of the configuration of the corresponding audible device 510 or 520 described above, and may seamlessly process the work exchange.

The program module of the audible device 500 described above may be implemented by corresponding hardware or corresponding electrical circuits.

For example, the power manager 1010 or 1050 may be implemented by a power management circuit that is configured to detect the battery level (e.g., the remaining amount or the charging amount of the battery), and the in-ear detector 1020 or 1060 may be implemented by a detection circuit that is configured to detect the wearing state or non-wearing state of the audible device 500. The Bluetooth manager 1030 or 1070 may be implemented by a wireless communication circuit that is configured to perform wireless communication with the electronic device 400 and/or the counterpart audible device, and the load balancer 1040 or 1080 may be implemented by a control circuit or the controller 970 that is configured to process the operation related to the dynamic work distribution between the first audible device 510 and the second audible device 520.

The controller 970 may include the first control circuit of the first audible device 510 and the second control circuit of the second audible device 520, and at least one of the first control circuit or the second control circuit may be configured to: obtain the battery ratio between the first battery level of the first audible device 510 and the second battery level of the second audible device 520; compare the battery ratio with at least one of a plurality of reference ratios; and control the operation of at least one of the first control circuit or the second control circuit based on at least some of the comparison.

As described above, the audible device 500 (e.g., the first audible device 510 or the second audible device 520) may include: the first audible device 510 that is configured to include the battery of the first audible device 510 that is configured to be rechargeable, the power manager 1010 of the first audible device 510 that is configured to detect the first battery level of the first battery, the wireless communication unit 910 or the Bluetooth manager 1030 of the first audible device 510, a first electronic component (e.g., the program module or hardware module of the first audible device 510 (e.g., an audio player or sensors)), and a the controller 970 or the load balancer 1040 of the first audible device 510 that is configured to be electrically connected with the first power management circuit, the first wireless communication circuit, and the first electronic component; and the second audible device 520 that is configured to be separated from the first member and configured to include the battery of the second audible device 520 that is configured to be rechargeable, the power manager 1050 of the second audible device 520 that is configured to detect the second battery level of the second battery, the wireless communication unit 910 of the second audible device 520 that is configured to communicate with the first wireless communication circuit by wireless communication, a second electronic component (e.g., the program module or hardware module of the second audible device 520 (e.g., an audio player or sensors)), and a the controller 970 or the load balancer 1080 of the second audible device 520 that is configured to be electrically connected with the second power management circuit, the second wireless communication circuit, and the second electronic component, wherein at least one of the first control circuit or the second control circuit is configured to: obtain the battery ratio between the first battery level and the second battery level; compare the battery ratio with at least one of a plurality of reference ratios; and control the operation (e.g., the role conversion or the work distribution) of at least one of the first member or the second member based on at least some of the comparison.

The operation may include the operation of at least one of the first electronic component or the second electronic component.

At least one of the first control circuit or the second control circuit may be configured to control the operation such that the first member operates as a master device and the second member operates as a slave device, or such that the second member operates as a master device and the first member operates as a slave device.

At least one of the first electronic component or the second electronic component may include a sensor.

The sensor may include a biometric sensor.

The first electronic component may include the first audio player, and the second electronic component may include the second audio player, wherein at least one of the first control circuit or the second control circuit may be configured to synchronize the first audio player with the second audio player.

The first member may include the first earphone, and the second member may include the second earphone, wherein at least one of the first control circuit or the second control circuit may be configured to synchronize the first earphone with the second earphone.

At least one of the first control circuit or the second control circuit may be configured to control the operation of at least one of the role conversion or the work redistribution of the first member and the second member based on at least some of the state information of the first member and the second member.

The state information may contain at least one of the battery level or the wearing state information.

At least one of the first control circuit or the second control circuit may be configured to: determine a reference ratio that is close to the battery ratio among the plurality of reference ratios; and control the operation of at least one of the first member or the second member based on at least some of the determination.

The reference ratio may include the workload ratio of the first member and the second member.

As described above, an audible device 500 may include: a battery configured to be rechargeable; the power manager 1010 or 1050 that is configured to detect the first battery level of the battery; the wireless communication unit 910 or the Bluetooth manager 1030 preference 1070 that is configured to communicate with the other audible device by wireless communication; an electronic component (e.g., the program module or hardware module of the audible device 500 (e.g., the audio player or the sensors)); and the controller 970 or the load balancer 1040 or 1080 that is configured to be electrically connected with the power management circuit, the wireless communication circuit, and the electronic component, wherein the control circuit may be configured to: establish a connection with the other audible device by using the wireless communication circuit; receive the second battery level of the other audible device by using the wireless communication circuit; obtain the battery ratio between the first battery level and the second battery level; compare the battery ratio with at least one of a plurality of reference ratios (e.g., the workload ratio); and control the operation (e.g., the role conversion or the work distribution) of at least one of the audible device or the other audible device based on at least some of the comparison.

The operation may include the operation of at least one of the electronic component of the audible device or the electronic component of the other audible device.

The control circuit may be configured to control the operation such that the audible device operates as a master device and the other audible device operates as a slave device, or such that the other audible device operates as a master device and the audible device operates as a slave device.

The electronic component may include a sensor.

The sensor may include a biometric sensor.

The electronic component may include an audio player, and the control circuit may be configured to synchronize the audio player of the audible device with the audio player of the other audible device.

The audible device may include the first earphone, and the other audible device includes the second earphone, wherein the control circuit may be configured to synchronize the first earphone with the second earphone.

The control circuit may be configured to control the operation of at least one of the role conversion or the work redistribution of the audible device and the other audible device based on at least some of state information of the audible device and the other audible device.

The state information may contain at least one of the battery level or the wearing state information.

The control circuit may be configured to: determine a reference ratio that is close to the battery ratio among the plurality of reference ratios; and control the operation of at least one of the first member or the second member based on at least some of the determination.

The reference ratio may include the workload ratio of the first member and the second member.

Hereinafter, in various embodiments, the dynamic work distribution, according to the state of the audible device 500, will be described.

Figure 11:
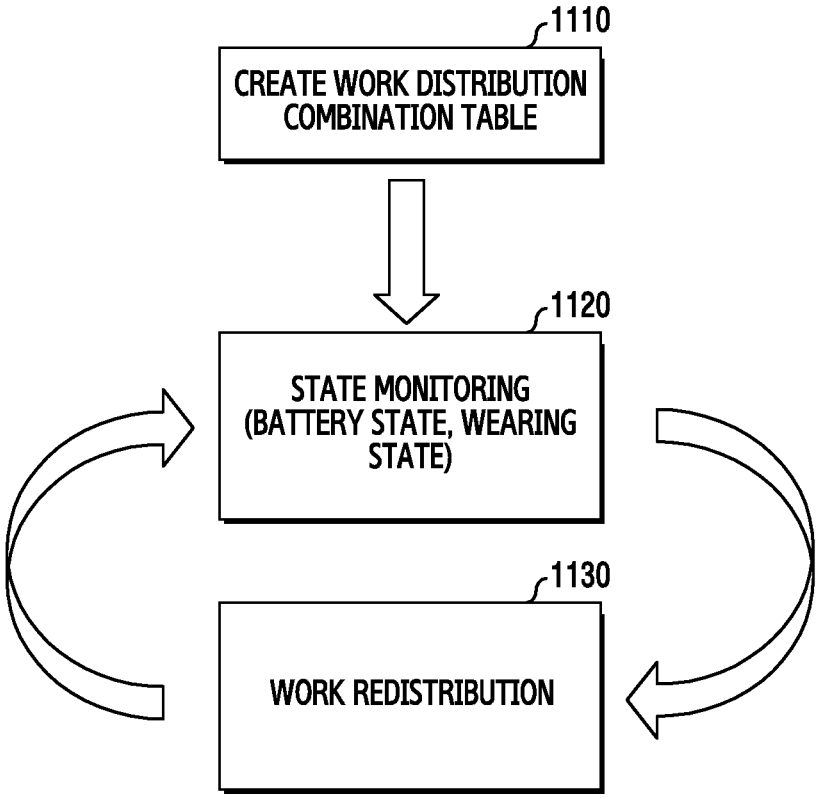
FIG. 11 is a diagram illustrating distributing works of the audible device, according to an embodiment of the present disclosure.

FIG. 11 is a diagram illustrating distributing works of the audible device, according to an embodiment of the present disclosure.

Referring to FIG. 11, the work distribution of the audible device may include the steps of creating a work distribution combination table (1110); monitoring (1120); and redistributing works (1130).

The step of creating the work distribution combination table (1110) may include obtaining and creating all work distribution combinations that can be operated between the first audible device 510 and the second audible device 520 or the battery consumption rates corresponding to the work distribution combinations.

The step of monitoring (1120) may include periodically checking the battery ratio and determining the work redistribution if there is a more suitable combination than the current battery ratio of each audible device 510 or 520, or if the counterpart audible device is not available.

The step of redistributing works (1130) may include redistributing works between the first audible device 510 and the second audible device 520 through an appropriate protocol according to the work redistribution combination when the work redistribution is determined.

Hereinafter, the steps of redistributing works of the audible device, according to various embodiments, will be described in detail.

The works may include a work that consumes the current in the first audible device 510 and the second audible device 520. The workload may include the current that is consumed for the corresponding operation in the battery determination (measurement) cycle. The work distribution determination cycle may be expressed by the time in which the battery 1 is consumed when the work having the minimum workload is independently executed on the assumption that the total amount of the battery is 100.

The classification of the works of the audible device 500 may be shown as illustrated in Table 1 below.

TABLE 1

| Work classification | Definition | Examples |
|---|---|---|
| Undistributable works (works fixed to each audible device) | Works that can be performed only by a fixed audible device and is not distributable because of limitations of hardware configuration | Music control is fixed to one audible device |
| Distributable works | Works that can be performed by either of the audible devices | Sensor work - Sensor can operate in either of the audible devices |
| Exchangeable works | Works that can be exchanged by exchanging related works with the other audible device | Master works, Slave works |

The work distribution may be performed if the workload ratio can be adjusted to be closer to the battery ratio in the work distribution determination cycle, or if one of the audible devices is not available (e.g., taking-off or power-off).

Hereinafter, the work distribution based on the battery ratio will be described.

The workload ratio that is closer to the battery ratio will be described. Table 2 below may represent the example of the works allocated to the audible device 500.

TABLE 2

| Works | Executable Audible device | Workload | Related Works |
|---|---|---|---|
| L Dedicated Works | L | 4 | |
| R Dedicated Works | R | 5 | |
| Sensor | Both | 3 | |
| Music | Both | 2 | |
| Master | Both | 4 | Slave |
| Slave | Both | 1 | Master |

The works may be classified into undistributable works (e.g., works fixed to the first audible device 510 and the second audible device 520), distributable works, and exchangeable works. The fixed works, for example, may refer to works (L Dedicated works or R Dedicated works) that are fixed to the left audible device (e.g., the first audible device 510 or the L piece) and the right audible device (e.g., the second audible device 520 or the R piece) in Table 2. The distributable works may represent works for sensors or music in Table 2. The exchangeable works may represent master works or slave works in Table 2.

The work distribution, for example, may be made by eight combinations between the first audible device 510 and the second audible device 520, including the fixed works, as shown in Table 3, and the workload ratio of the first audible device 510 and the second audible device 520 may be calculated.

TABLE 3

| Combination | L Piece Work | L Piece Workload | R Piece Work | R Piece Workload | R/L Workload Ratio |
|---|---|---|---|---|---|
| 1 | Master | 8 | Slave, Sensor, Music | 11 | 1.375 |
| 2 | Slave | 5 | Master, Sensor, Music | 14 | 2.8 |
| 3 | Master, Sensor | 11 | Slave, Music | 8 | 0.72 |
| 4 | Slave, Sensor | 8 | Master, Music | 11 | 1.375 |
| 5 | Master, Music | 10 | Slave, Sensor | 9 | 0.9 |
| 6 | Slave, Music | 7 | Master, Sensor | 12 | 1.714 |
| 7 | Master, Sensor, Music | 13 | Slave | 6 | 0.46 |
| 8 | Slave, Sensor, Music | 10 | Master | 9 | 0.9 |

The work distribution may be performed to distribute the work in which each audible device has a closest R/L workload ratio to the current battery R/L ratio (e.g., the battery ratio of each of the first audible device 510 and the second audible device 520) in the battery measurement cycle. For example, referring to Table 3, on the assumption that the current battery R/L ratio is 3.0, the works may be redistributed according to Combination 2 that has the closest value in Table 3.

The steps of applying the work distribution method described above may be performed as follows.

Provided that the first audible device 510 (e.g., the L piece) and the second audible device 520 (e.g., the R piece) have the same amount of battery, which is 100, the workload distribution may be dynamically performed as shown in Table 4 below so that the first audible device 510 and the second audible device 520 operate until Timeline 11. Table 4 below may show an example of the dynamic work distribution method when the amount of battery of each of the first audible device 510 and the second audible device 520 is 100 in various embodiments.

TABLE 4

| Timeline | Workload | L Piece | Workload | R Piece | R/L Battery Ratio | Applied Ratio |
|---|---|---|---|---|---|---|
| 1 | Master, Music | 100 | Slave, Sensor | 100 | 1 | 0.9 |
| 2 | | 90 | | 91 | 1.011111111 | 0.9 |
| 3 | | 80 | | 82 | 1.025 | 0.9 |
| 4 | | 70 | | 73 | 1.042857143 | 0.9 |
| 5 | | 60 | | 64 | 1.066666667 | 0.9 |
| 6 | | 50 | | 55 | 1.1 | 0.9 |
| 7 | | 40 | | 46 | 1.15 | 0.9 |
| 8 | Master | 30 | Slave, Sensor, Music | 37 | 1.233333333 | 1.375 |
| 9 | | 22 | | 26 | 1.181818182 | 1.375 |
| 10 | Master, Music | 14 | Slave, Sensor, Music | 15 | 1.071428571 | 0.9 |
| 11 | | 4 | | 4 | 1 | 0.9 |
| 12 | | −6 | | −5 | | |

On the contrary, in the case where the sensor work is fixed to the first audible device 510 (e.g., the L piece) and the music work is fixed to the second audible device 520 (e.g., the R piece), the first audible device 510 and the second audible device 520 may operate until Timeline 10. Table 5 below may show an example of a fixed work method when the amount of battery of each of the first audible device 510 and the second audible device 520 is 100.

TABLE 5

| Timeline | Workload | L Piece | Workload | R Piece | R/L Battery Ratio |
|---|---|---|---|---|---|
| 1 | Slave, Sensor | 100 | Master, Music | 100 | 1 |
| 2 | | 92 | | 89 | 0.967391304 |
| 3 | | 84 | | 78 | 0.928571429 |
| 4 | | 76 | | 67 | 0.881578947 |
| 5 | | 68 | | 56 | 0.823529412 |
| 6 | | 60 | | 45 | 0.75 |
| 7 | | 52 | | 34 | 0.653846154 |
| 8 | Master | 44 | | 23 | 0.522727273 |
| 9 | | 36 | | 12 | 0.333333333 |
| 10 | | 28 | | 1 | 0.035714286 |
| 11 | | 20 | | −10 | −0.5 |

If the battery difference between the first audible device 510 and the second audible device 520 significantly increases, the difference of the usage time may become greater. For example, if it is assumed that the operation is initiated in the state in which the battery amount of the first audible device 510 (e.g., the L piece) is 100 and the battery amount of the second audible device 520 (e.g., the R piece) is 40, the audible devices may operate until Timeline 7, as shown in Table 6 below, in the case of using the dynamic work distribution method, according to various embodiments, whereas the audible devices may operate until Timeline 4, as shown in Table 7 below, in the case of using the fixed work method. Table 6 and Table 7 below may show an example of the dynamic work distribution method (Table 6) and the fixed work method (Table 7) when the battery amount of the first audible device 510 (e.g., the L piece) is 100 and the battery amount of the second audible device 520 (e.g., the R piece) is 40.

TABLE 6

| Timeline | Workload | L Piece | Workload | R Piece | R/L Battery Ratio | Applied Ratio |
|---|---|---|---|---|---|---|
| 1 | Master, Sensor, Music | 100 | Slave | 40 | 0.4 | 0.46 |
| 2 | | 87 | | 34 | 0.390804598 | 0.46 |
| 3 | | 74 | | 28 | 0.378378378 | 0.46 |
| 4 | | 61 | | 22 | 0.360655738 | 0.46 |
| 5 | | 48 | | 16 | 0.333333333 | 0.46 |
| 6 | Master, Sensor | 13 | Slave, Music | 10 | 0.769230769 | 0.72 |
| 7 | Master, Music | 2 | Slave, Sensor | 2 | 1 | 0.9 |
| 8 | Slave | −8 | Master, Sensor, Music | −7 | 0.875 | |

TABLE 7

| Timeline | Workload | L Piece | Workload | R Piece | R/L Battery Ratio |
|---|---|---|---|---|---|
| 1 | Slave, Sensor | 100 | Master, Music | 40 | 0.4 |
| 2 | | 92 | | 29 | 0.315217391 |

TABLE 7-continued

| Time-line | Workload | L Piece | Workload | R Piece | R/L Battery Ratio |
|---|---|---|---|---|---|
| 3 | | 84 | | 18 | 0.214285714 |
| 4 | | 76 | | 7 | 0.092105263 |
| 5 | | 68 | | −4 | −0.058823529 |

Hereinafter, the work distribution according to the wearing (usage) state will be described.

In the case where the workload is fixedly distributed (for example, the reproduction of music is fixed to the first audible device 510 (e.g., the L piece) and the sensor work is fixed to the second audible device 520 (e.g., the R piece)), if the user, for example, exercises while wearing only the second audible device 520, sensor data cannot be obtained so that an exercise coaching function is not available. In addition, if either of the audible devices is discharged first, the function that is fixed to the corresponding audible device is not available.

The availability of the audible device 500 is determined in order to dynamically distribute the works to the available audible device. Therefore, even though the user uses only one of the audible devices, the functions can be used without dependency on the hardware. This will be described with reference to FIG. 12.

Figure 12:
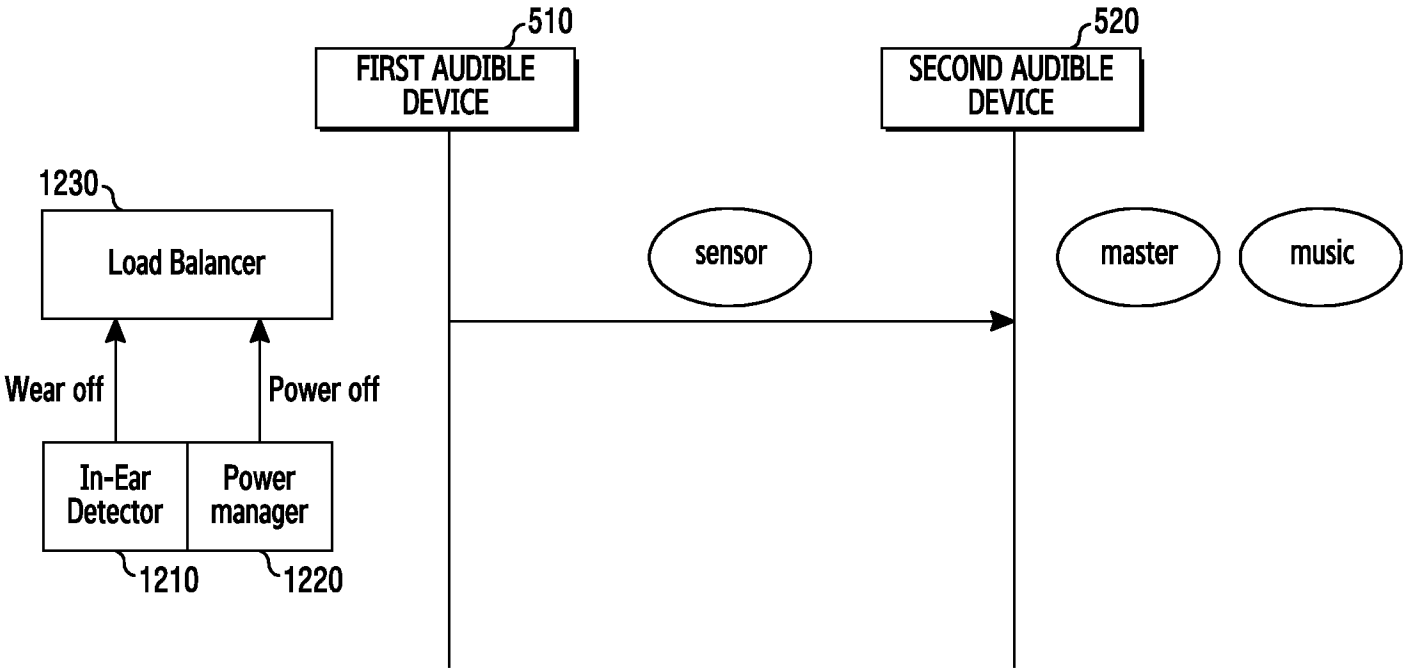
FIG. 12 is a diagram illustrating distributing works of the audible device, according to an embodiment of the present disclosure.

FIG. 12 is a diagram illustrating distributing the works of the audible device, according to an embodiment of the present disclosure.

If the audible device 500 determines that the user uses only one of the audible devices, the audible device 500 may transfer the work of the audible device, which is not in use, to the available audible device in order to thereby allow the available audible device to perform the work of the other audible device.

Referring to the illustration of FIG. 12, as shown in FIG. 12, the in-ear detector 1210 of the first audible device 510 (e.g., the L piece) may detect whether or not the first audible device 510 is worn on the user's ear in order to thereby transfer related state information to the load balancer 1230. Alternatively, the power manager 1220 may detect (or expect) that the first audible device 510 will be turned off due to a low battery, and may transfer the related state information to the load balancer 1230.

The load balancer 1230 may receive the related state information based on at least one of the in-ear detector 1210 or the power manager 1220, and may determine whether or not the first audible device 510 is in use while being worn on the user or whether or not the first audible device 510 is expected to be turned off due to a low battery based on the related state information.

If the load balancer 1230 determines that the first audible device 510 is not in use by the user (that is, the first audible device 510 is not worn on the user) through the in-ear detector 1210, or if the load balancer 1230 determines that the first audible device 510 is expected to be turned off through the power manager 1220, the load balancer 1230 may distribute the works of the first audible device 510 to the second audible device 520. For example, in various embodiments, in the case where the user takes off the first audible device 510, or in the case of a low battery, distributable works may be transferred to the other audible device so that the other audible device may perform the related works.

Referring to FIG. 12, the first audible device 510 may distribute the sensor work, which has been allocated to the first audible device 510, to the second audible device 520 to perform the same. The second audible device 520 may process the sensor work of the first audible device 510, which is additionally distributed, as well as the allocated works (e.g., the master role or music).

In the description above, the timing and criteria for the work distribution have been described. Hereinafter, the description will be made of a sequence in which the works are distributed.

The work distribution may be differently processed depending on whether or not the work is related to the connection with the electronic device 400, and thus, the works may be classified into two types as the example shown in Table 8.

TABLE 8

| Type of work | Definition | Examples |
|---|---|---|
| Connection-related works | Works that are related to a connection with the electronic device | Master and slave works in reproducing sound sources through streaming from electronic device |
| Connection-unrelated works | Works that are not related to a connection with the electronic device | Algorithm and sensor operation for health information tracking |

Currently, most audible devices provide a function of receiving music data by means of streaming through a Bluetooth connection with the electronic device 400 and reproducing the same. In this case, the roles of a master and a slave of the audible devices may be shown as the example of Table 9 below.

TABLE 9

| Roles | Operation |
|---|---|
| Master | being connected to electronic device by Bluetooth; receiving sound sources through streaming from electronic device; transferring synchronization information and sound sources to slave; and reproducing sound sources according to synchronization time |
| Slave | being connected to master by Bluetooth; receiving sound sources and synchronization information from master; and reproducing sound sources according to synchronization information |

As shown in Table 9, the works to be exchanged by the audible devices may include the master/slave roles. Due to this, a method is required, which can seamlessly change the connection with the electronic device 400 in order to not discontinue the reproduction of the sound source during the work exchange between the audible devices.

Hereinafter, according to various embodiments, the step of exchanging works between the first audible device 510 and the second audible device 520 will be described in consideration of the works that are related to the connection between the audible device 500 and the electronic device 400 and the works that are not related to the same (for example, depending on the battery difference during the streaming) with reference to FIGS. 13 and 14.

Figure 13:
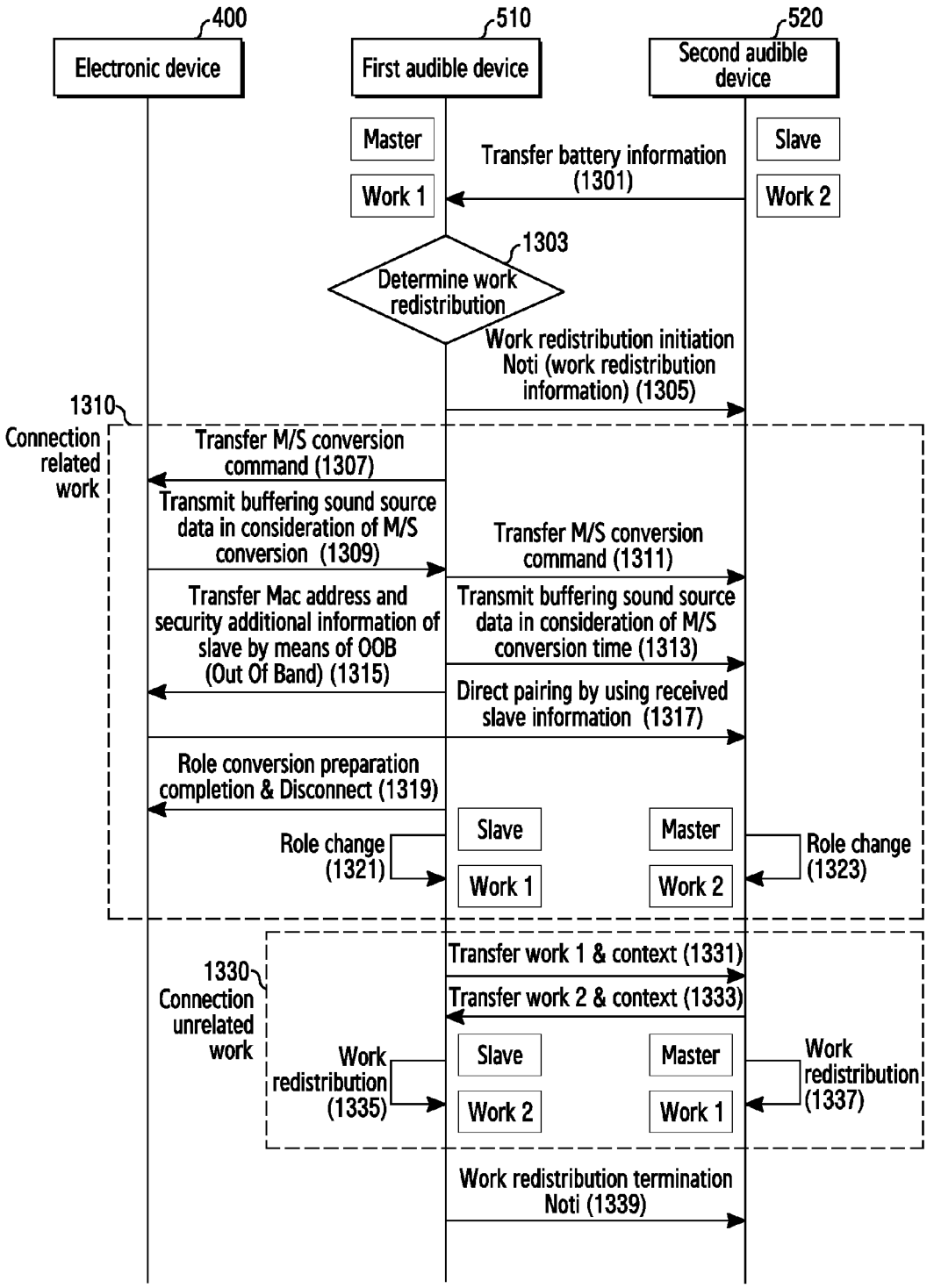
FIG. 13 is a diagram illustrating an operation of distributing works between the audible devices, according to an embodiment of the present disclosure.

FIG. 13 is a diagram illustrating an operation of distributing works between the audible devices, according to various embodiments of the present disclosure.

In FIG. 13, for example, it is assumed that: the first audible device 510 operates as a master; the workload of the first audible device 510 is more than that of the second audible device 520; the second audible device 520 operates as a slave; and the workload of the second audible device 520 is less than that of the first audible device 510.

The transfer of the battery state information (e.g., the battery level) may be perform by a slave device in the case where the electronic device 400 is connected with a master device, or may be performed by the audible device, of which the battery level is high, in the case where the electronic device 400 is not connected. For example, in various embodiments, the priority for transferring the battery state information may be given to the slave audible device, or may be given to the audible device that has a high battery level depending on the connection or non-connection with the electronic device 400. Since a master device takes lead in the work distribution when the electronic device 400 is connected, it may be preferable to receive the battery state information from a slave device. In addition, in the case where the electronic device 400 is not connected, the audible device, which has a higher battery level, may play the role of transferring the battery state.

Referring to FIG. 13, in step 1301, the second audible device 520 may transfer the battery state information (e.g., the battery level of the second audible device 520) to the first audible device 510. The second audible device 520, which plays the role of transferring the battery information, may transfer the battery state information to the other audible device. When the electronic device 400 and the first audible device case 510 are connected, the second audible device 520 of a slave may transfer the battery state information of the second audible device 520 (hereinafter, the second battery level) to the first audible device 510 of a master. FIG. 13 shows a state in which the master role and Work 1 are allocated (or distributed) to the first audible device 510 and the slave role and Work 2 are allocated to the second audible device 520.

In step 1303, the first audible device 510 may determine whether or not the work redistribution is to be made. The audible device may determine the work redistribution when the adjustment of the workload ratio is required according to the work distribution determination cycle or one of the audible devices is not available (e.g., taking-off or power-off). For example, the load balancer of the first audible device 510 may determine the workload ratio according to the battery ratio of the first audible device 510 to the second audible device 520, and may determine the work distribution according to the result thereof.

The first audible device 510 may compare the second battery level of the second audible device 520 with battery state information of the first audible device 510 (hereinafter, the first battery level). The first audible device 510 may determine the work distribution based on the comparison result. For example, as described above, the first audible device 510 may distribute the work that has the closest R/L workload ratio of each audible device to the battery ratio of each of the first audible device 510 and the second audible device 520. For example, the load balancer of the first audible device 510 may determine the work distribution from the master role and Work 1 to the slave role and Work 2 with respect to the first audible device 510, and may determine the work distribution from the slave role and Work 2 to the master role and Work 1 with respect to the second audible device 520.

In step 1305, the first audible device 510 may transmit, to the second audible device 520, a notification of work redistribution initiation, which contains work redistribution information.

In step 1310 (e.g., step 1307 to step 1323), the first audible device 510, the second audible device 520, and the electronic device 400 may perform the operation for exchanging the connection-related works.

In step 1307, the first audible device 510 may transmit a master/slave conversion command to the electronic device 400. The first audible device 510 may include information on the time required for the master/slave conversion (e.g., the conversion time) in the same to then be transmitted.

In step 1309, the electronic device 400 may transmit, to the first audible device 510, buffering sound source data in consideration of the conversion time of the first audible device 510 from the master to the slave. For example, the electronic device 400 may transmit, to the first audible device 510, the buffering sound source data in order to seamlessly reproduce the same during the master/slave conversion time of the first audible device 510. The buffering sound source data may contain the first sound source data for the first audible device 510 and the second sound source data for the second audible device 520.

In step 1311, the first audible device 510 may transmit the master/slave conversion command to the second audible device 520.

In step 1313, the first audible device 510 may transmit the buffering sound source data to the second audible device 520 sequentially or in parallel to the conversion command. For example, the first audible device 510 may transmit, to the second audible device 520, the buffering sound source data (e.g., the second sound source data) in consideration of the master/slave conversion time.

In step 1315, the first audible device 510 may transmit, to the electronic device 400, connection information by which the electronic device 400 may connect to the second audible device 520. The first audible device 510 may transmit, to the electronic device 400, connection information, such as the MAC address and/or security information of the second audible device 520, through out of band (00B). The first audible device 510 and the second audible device 520 may recognize the connection information between them in the course of the pairing between a master and a slave, and the electronic device 400 may cache the connection information to then reuse the same in the next conversion operation.

In step 1317, in response to the reception of the connection information of the second audible device 520 from the first audible device 510, the electronic device 400 may perform a direct pairing with the second audible device 520 based on the received connection information.

In step 1319, the first audible device 510 may notify the electronic device 400 that the preparation for the role conversion is completed, and may disconnect from the electronic device 400. The step 1319 may be performed prior, or in parallel, to operation 1317.

In step 1321 and step 1323, the first audible device 510 and the second audible device 520 may change roles. For example, the first audible device 510 may change the role from a master to a slave in step 1321, and the second audible device 520 may change the role from a slave to a master in step 1323. The first audible device 510 and the second audible device 520 may maintain the works (e.g., Work 1 and Work 2) that were previously configured when changing the roles.

In step 1330 (e.g., step 1331 to step 1339), the first audible device 510 and the second audible device 520 may perform the operation of distributing works that are not related to the connection.

In step 1331, the first audible device 510 may transmit, to the second audible device 520, Work 1 and information related thereto. For example, the first audible device 510 may transmit, to the second audible device 520, Work 1, which has been distributed to the first audible device 510, and the context (e.g., status information) for resuming Work 1 in the second audible device 520. Provided that Work 1 of the first audible device 510 is a work related to the sensor operation, the first audible device 510 may provide the second audible device 520 with a command to perform the work for the sensor operation and the context related to currently measured health information (e.g., the accumulated distance, calories, or steps) in order for the second audible device 520 to continuously perform the work for the sensor operation.

In step 1333, the second audible device 520 may transmit, to the first audible device 510, Work 2 and information related thereto. For example, the second audible device 520 may transmit, to the first audible device 510, Work 2, which has been distributed to the second audible device 520, and the context (e.g., status information) for resuming Work 2 in the first audible device 510.

In step 1335 and step 1337, the first audible device 510 and the second audible device 520 may perform the work redistribution. For example, the first audible device 510 may change the operation work from Work 1 to Work 2 in step 1335, and the second audible device 520 may change the operation work from Work 2 to Work 1 in step 1337.

In step 1339, the first audible device 510 may transmit a notification of work redistribution termination to the second audible device 520. For example, in response to the reception of Work 2 and the context from the second audible device 520, and in response to the work redistribution completion thereof, the first audible device 510 may identify whether or not the work redistribution by the first audible device 510 and the second audible device 520 is completed. The first audible device 510 may notify the second audible device 520 of the work redistribution termination when determining the work redistribution completion.

Figure 14:
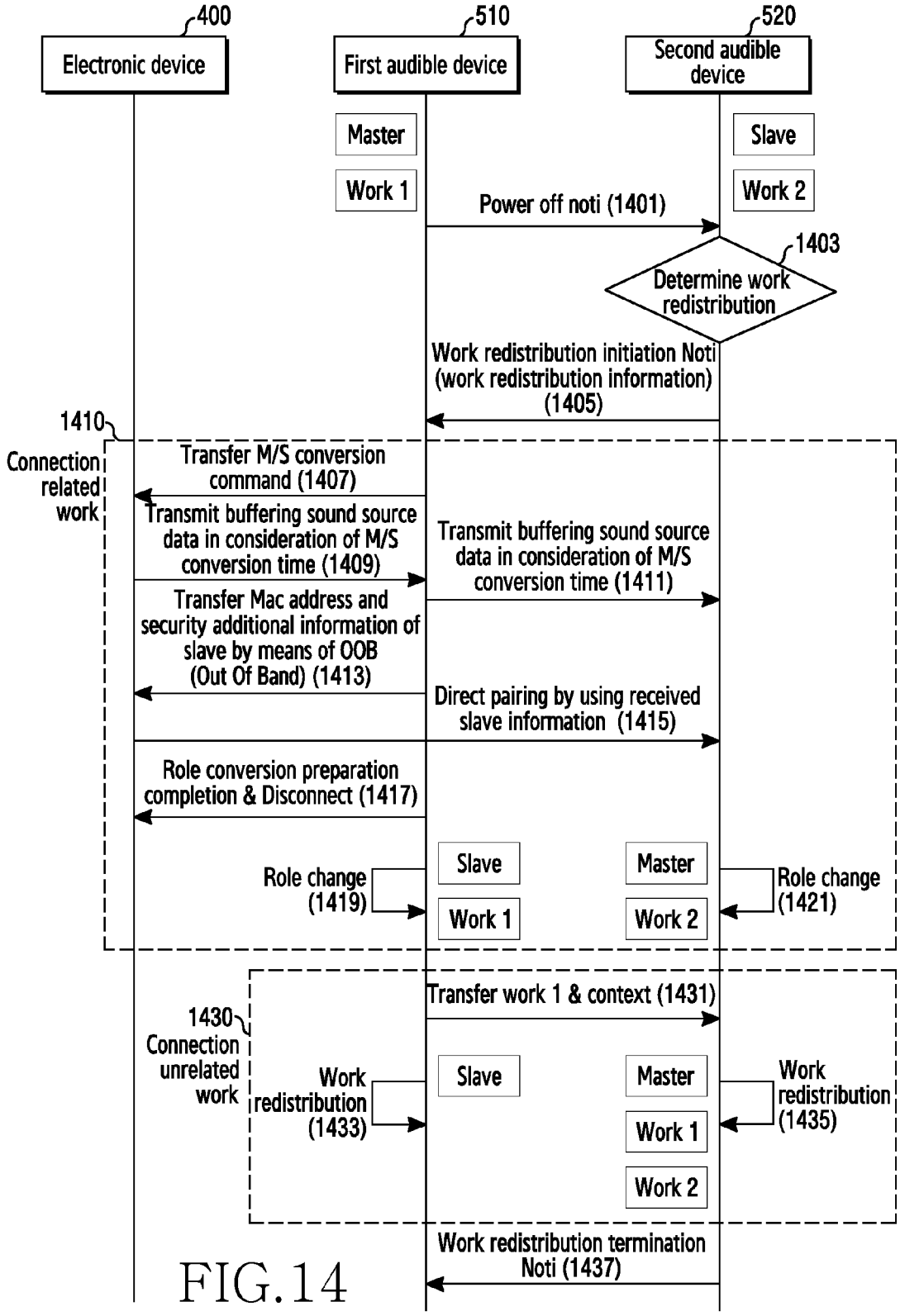
FIG. 14 is a diagram illustrating an operation of distributing works between the audible devices, according to an embodiment of the present disclosure.

FIG. 14 is a diagram illustrating distributing works between the audible devices, according to an embodiment of the present disclosure FIG. 14 shows that the first audible device 510 distributes the role of a master and the work of the first audible device 510 to the second audible device 520 in the case in which the first audible device 510 operates as a master and is expected to be turned off (or a low battery).

Referring to FIG. 14, in step 1401, the first audible device 510 may transmit a power-off notification to the second audible device 520. For example, the load balancer of the first audible device 510 may determine the battery level of the first audible device 510 through the power manager in order to thereby expect whether or not the first audible device 510 enters the power-off state due to a low battery. FIG. 14 shows that the master role and Work 1 have been allocated (distributed) to the first audible device 510 and the slave role and Work 2 have been allocated to the second audible device 520.

In step 1403, the second audible device 520 may determine whether or not the work redistribution is to be made. The audible device may determine the work redistribution when the adjustment of the workload ratio is required according to the work distribution determination cycle or one of the audible devices is not available (e.g., taking-off, a low battery, or power-off). For example, the load balancer of the first audible device 510 may expect that the power will be turned off due to a low battery, and may determine the work distribution according to the result thereof.

In step 1405, the second audible device 520 may transmit, to the first audible device 510, a notification of work redistribution initiation, which contains work redistribution information.

In step 1410 (e.g., step 1407 to step 1421), the first audible device 510, the second audible device 520, and the electronic device 400 may perform the operation for exchanging the connection-related works.

In step 1407, the first audible device 510 may transmit a master/slave conversion command (e.g., a request for connection conversion into the second audible device 520) to the electronic device 400. The first audible device 510 may include information on the time required for the master/slave conversion (e.g., the conversion time) in the same to then be transmitted.

In step 1409, the electronic device 400 may transmit, to the first audible device 510, buffering sound source data in consideration of the conversion time of the first audible device 510 from a master to a slave. For example, the electronic device 400 may transmit, to the first audible device 510, the buffering sound source data in order to seamlessly reproduce the same during the master/slave conversion time of the first audible device 510. The buffering sound source data may contain the first sound source data for the first audible device 510 and the second sound source data for the second audible device 520.

In step 1411, the first audible device 510 may transmit the buffering sound source data to the second audible device 520. For example, the first audible device 510 may transmit, to the second audible device 520, the buffering sound source data (e.g., the second sound source data) in consideration of the master/slave conversion time.

In step 1413, the first audible device 510 may transmit, to the electronic device 400, connection information by which the electronic device 400 connects to the second audible device 520. The first audible device 510 may transmit, to the electronic device 400, connection information, such as the MAC address and/or security information of the second audible device 520, through OOB. The first audible device 510 and the second audible device 520 may recognize the connection information between them in the course of the pairing between a master and a slave, and the electronic device 400 may cache the connection information to then reuse the same in the next conversion operation.

In step 1415, in response to the reception of the connection information of the second audible device 520 from the first audible device 510, the electronic device 400 may perform a direct pairing with the second audible device 520 based on the received connection information.

In step 1417, the first audible device 510 may notify the electronic device 400 that the preparation for the role conversion is completed, and may disconnect from the electronic device 400. Step 1417 may be performed prior, or in parallel, to step 1415.

In step 1419 and step 1421, the first audible device 510 and the second audible device 520 may change roles. For example, the first audible device 510 may change the role from a master to a slave in step 1419, and the second audible device 520 may change the role from a slave to a master in step 1421. The first audible device 510 and the second audible device 520 may maintain the works (e.g., Work 1 and Work 2) that were previously configured when changing roles.

In step 1430 (e.g., step 1431 to step 1437), the first audible device 510 and the second audible device 520 may perform the operation of distributing works that are not related to the connection.

In step 1431, the first audible device 510 may transmit, to the second audible device 520, Work 1 and information related thereto. For example, the first audible device 510 may transmit, to the second audible device 520, Work 1, which has been distributed to the first audible device 510, and the context (e.g., status information) for resuming Work 1 in the second audible device 520. Provided that Work 1 of the first audible device 510 is a work related to the sensor operation, the first audible device 510 may provide the second audible device 520 with a command to perform the work for the sensor operation and the context related to currently measured health information (e.g., an accumulated distance, calories, or steps) in order for the second audible device 520 to continuously perform the work for the sensor operation.

In step 1433 and step 1435, the first audible device 510 and the second audible device 520 may perform the work redistribution. For example, the first audible device 510 may have no work to be executed therein according to the work redistribution in step 1433, and the second audible device 520 may have Work 2, which has been redistributed, in addition to existing Work 1 according to the work redistribution in step 1435. For example, the second audible device 520 may process all works related to Work 1 and Work 2 sequentially, periodically, or in parallel.

In step 1437, the second audible device 520 may transmit a notification of work redistribution termination to the first audible device 510. For example, in response to the reception of Work 1 and the context from the first audible device 510, and in response to the work redistribution completion thereof, the second audible device 520 may identify whether or not the work redistribution by the first audible device 510 and the second audible device 520 is completed. The second audible device 520 may notify the first audible device 510 of the work redistribution termination when determining the work redistribution completion.

In the case where the audible device 500 is not connected with the electronic device 400, the audible device 500 may omit the operation for the connection-related work distribution between the first audible device 510 and the second audible device 520, and may perform the operation for connection-unrelated work distribution in the embodiments of FIGS. 13 and 14.

Figure 15:
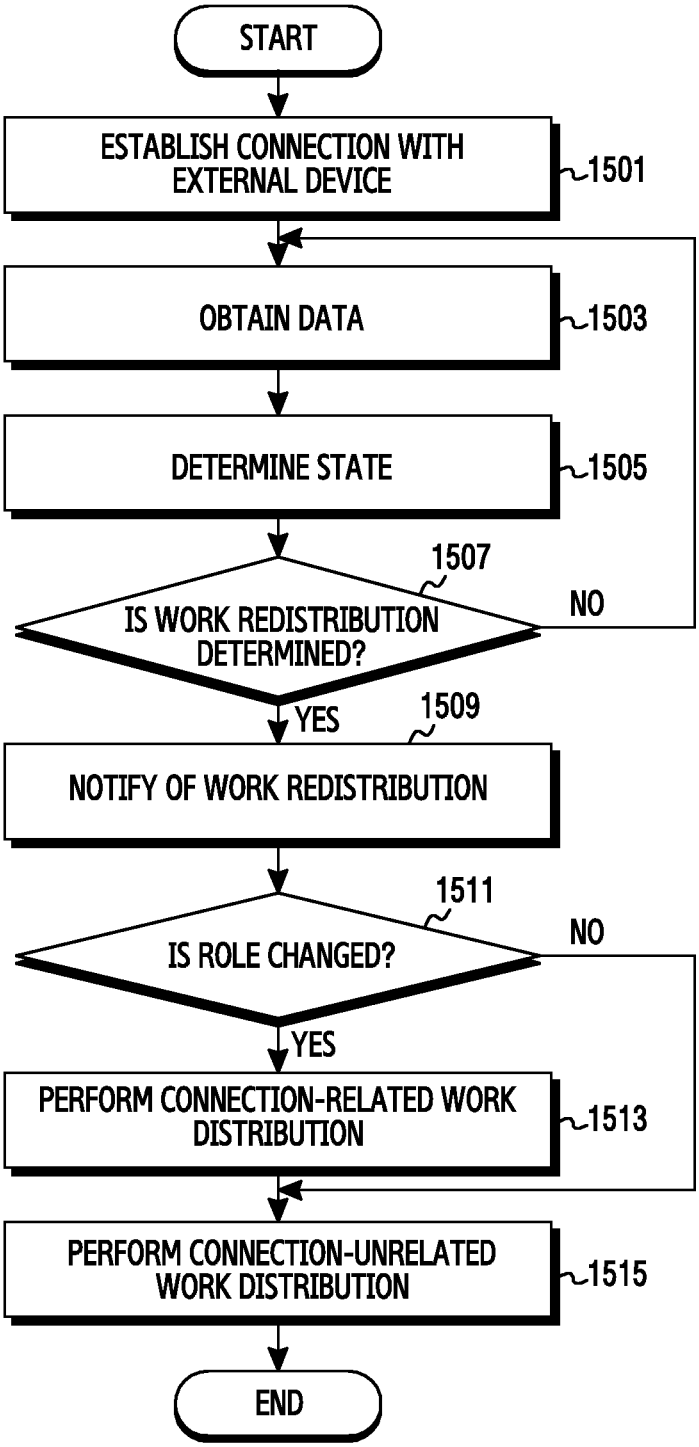
FIG. 15 is a flowchart of a method of the audible device, according to an embodiment of the present disclosure.

FIG. 15 is a flowchart of a method of the audible device, according to an embodiment of the present disclosure. FIG. 15 shows a method in the case where the audible device 500 operates a master device.

Referring to FIG. 15, in step 1501, the controller 970 of the audible device 500 may establish a connection with an external device. For example, provided that the audible device 500 is the first audible device 510 in FIG. 15, the first audible device 510 may establish a connection with the electronic device 400 through the first wireless communication. The first audible device 510 may establish a connection with the second audible device 520 of a slave device through the second wireless communication. The first wireless communication and the second wireless communication may be the same communication scheme, or may be different communication schemes. For example, the first wireless communication and the second wireless communication may include wireless communication, such as BT, BLE, or NFMI. The first wireless communication and the second wireless communication are not limited thereto, and may include a variety of other wireless communications, such as WiFi, NFC, ZigBee, UWB, or IrDA.

In step 1503, the controller 880 may obtain data. The controller 880 may perform an operation that is related to the acquisition of the data to correspond to the work distribution (measurement) determination cycle. The data may contain the first data that is related to the first audible device 510 and the second data that is related to the second audible device 520. The first data may contain data related to state information (e.g., the battery level of the first audible device 510 (e.g., the remaining amount of the battery included in the first audible device 510, hereinafter, referred to as the first battery level)), wearing information, or taking-off information of the first audible device 510. The second data may contain data related to state information (e.g., the battery level of the second audible device 520 (e.g., the remaining amount of battery included in the second audible device 520, hereinafter, referred to as the second battery level)), wearing information, or taking-off information of the second audible device 520.

In step 1503, the controller 970 may determine the state of the audible device 500 (e.g., the first audible device 510 or the second audible device 520) based on the first data and the second data, which are obtained. The controller 970 may detect the battery level of the first audible device 510 (e.g., the remaining amount of the first battery included in the first audible device 510, hereinafter referred to as the first battery level) based on the first data, and may detect the battery level of the second audible device 520 (e.g., the remaining amount of the second battery included in the second audible device 520, hereinafter referred to as the second battery level) based on the second data. The controller 970 may determine whether or not the first audible device 510 is in use by the user (e.g., wearing or non-wearing) based on the first data, and may determine whether or not the second audible device 520 is in use by the user (e.g., wearing or non-wearing) based on the second data. The controller 970 may determine whether or not the first audible device 510 is expected to be turned off based on the first data (e.g., the first battery level), and may determine whether or not the second audible device 520 is expected to be turned off based on the second data (e.g., the second battery level). The controller 970 may compare the first battery level with the second battery level, and may determine which battery level is higher among the first battery level or the second battery level based on the comparison result.

In step 1507, the controller 970 may determine whether or not the work redistribution is to be made. When it is determined that the adjustment of the workload ratio between the first audible device 510 and the second audible device 520 is required based on the obtained data, the controller 970 may determine the work redistribution of the first audible device 510 and the second audible device 520. When it is determined that one of the first audible device 510 or the second audible device 520 is not available (e.g., taking-off, a low battery, or power-off) based on the obtained data, the controller 970 may determine the work redistribution of the first audible device 510 and the second audible device 520.

If the work redistribution is not determined in step 1507 (No in step 1507), the controller 970 may proceed to step 1503 in order to thereby process the execution of step 1503 and subsequent operations.

If the work redistribution is determined in step 1507 (Yes in step 1507), the controller 970 may transmit a work redistribution notification to the connected audible device 500 in step 1509. For example, the controller 970 may transmit, to the second audible device 520 connected, a work redistribution notification that includes work redistribution information.

In step 1511, the controller 970 may determine whether or not to change the roles. For example, the controller 970 may determine whether or not the role change between the first audible device 510 and the second audible device 520 is required.

If it is determined that the role change is required in step 1511 (Yes in step 1511), the controller 970 may perform an operation that is related to the connection-related work distribution in step 1513. The controller 970, as described in the example with reference to step 1310 of FIG. 13, may perform the operation that is related to the negotiation between the first audible device 510 and the electronic device 400 and the negotiation between the first audible device 510 and the second audible device 520. The controller 970 may disconnect from the first audible device 510, and may switch the role of the first audible device 510 from a master to a slave.

In step 1515, the controller 970 may perform an operation that is related to the connection-unrelated work distribution after the role change. The controller 970, as described in the example with reference to step 1330 of FIG. 13, may perform an operation that is related to the negotiation between the first audible device 510 and the second audible device 520. The controller 970 may transmit, to the second audible device 520, the work, which was previously configured (allocated) to the first audible device 510, and the context that is related to the corresponding work, and may receive the work, which was previously configured (allocated) to the second audible device 520, and the context that is related to the corresponding work in order to thereby distribute the works.

If it is determined that the role change is not required in step 1511 (No in step 1511), the controller 970 may perform the operation that is related to the connection-unrelated work distribution, instead of performing the operation that is related to the connection-related work distribution, in step 1515.

In the case where the audible device 500 is not connected with the electronic device 400, the audible device 500 may not perform the operation that is related to the connection-related work distribution in FIG. 15, and may perform the step that is related to the connection-unrelated work distribution between the first audible device 510 and the second audible device 520.

When the controller 970 determines the state in which the first audible device 510 is not available (e.g., a low battery) based on the first battery level of the first audible device 510, the controller 970 may transmit a power-off notification of the first audible device 510 to the second audible device 520. In this case, in response to the work redistribution notification of the second audible device 520, the controller 970 may process the execution of the operation that is related to the aforementioned connection-related work and/or connection-unrelated work.

Figure 16:
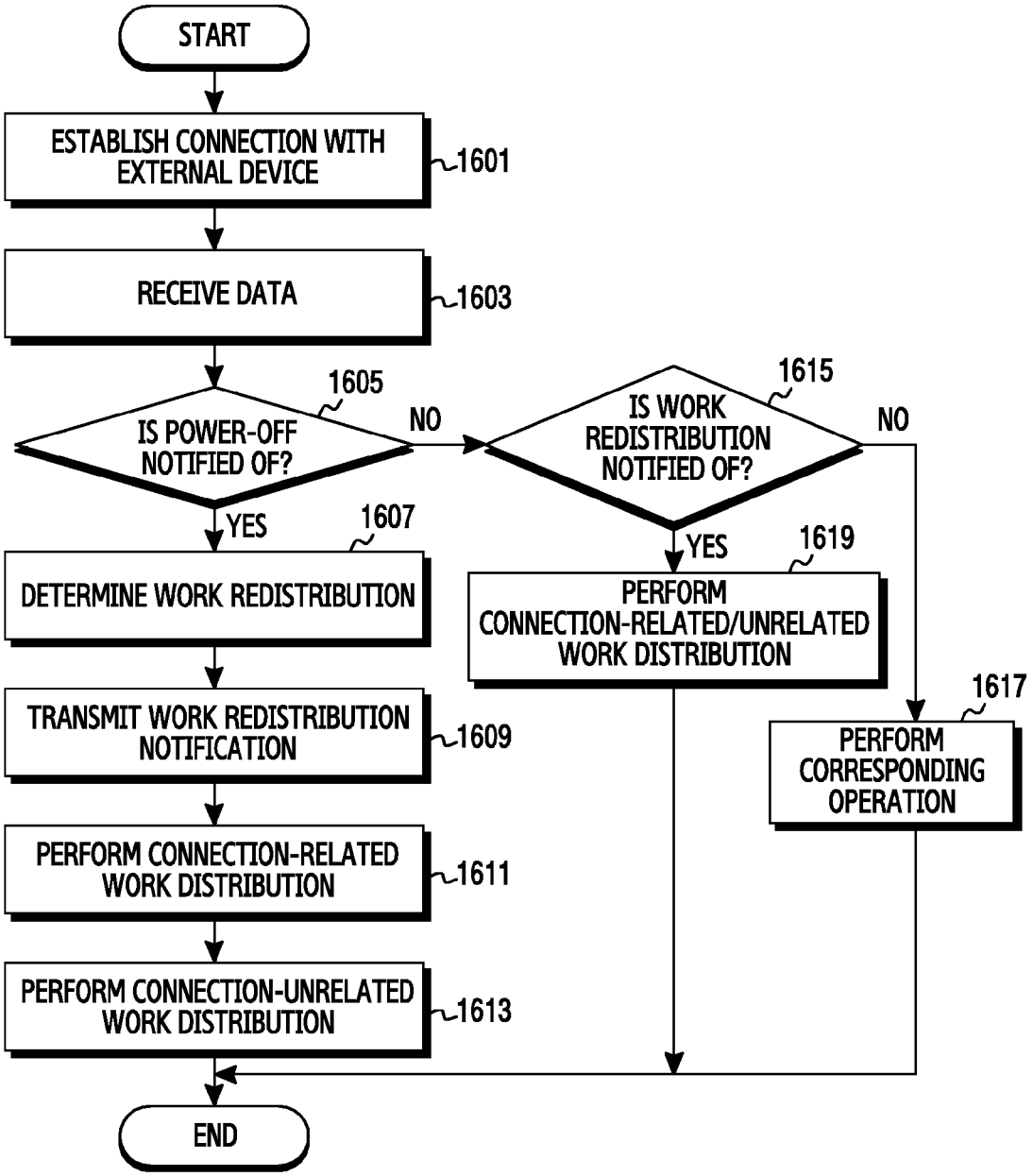
FIG. 16 is a flowchart of a method of the audible device, according to an embodiment of the present disclosure.

FIG. 16 is a flowchart of a method of the audible device, according to an embodiment of the present disclosure. FIG. 16 shows a method in the case where the audible device 500 operates as a slave device.

Referring to FIG. 16, in step 1601, the controller 970 of the audible device 500 may establish a connection with an external device. For example, provided that the audible device 500 is the second audible device 520 in FIG. 16, the second audible device 520 may establish a connection with the first audible device 510 through the wireless communication.

In step 1603, the controller 970 may receive data. For example, the controller 970 may receive a power-off notification of the first audible device 510 or a work redistribution notification from the first audible device 510, which is connected.

In step 1605, the controller 970 may determine whether the received data corresponds to the power-off notification or to the work redistribution notification.

If the received data is the power-off notification in step 1605 (Yes in step 1605), the controller 970 may determine whether or not the work redistribution is to be made in step 1607. In response to the reception of the power-off notification from the first audible device 510, which is connected, the controller 970 may determine the state in which the first audible device 510 is not available (e.g., a low battery or power-off) in order to thereby determine the work redistribution of the first audible device 510 and the second audible device 520.

The controller 970 may transmit a work redistribution notification to the connected audible device 500 in step 1609. For example, the controller 970 may transmit, to the first audible device 510 connected, a work redistribution notification that includes work redistribution information.

In step 1611, the controller 970 may perform an operation that is related to the connection-related work distribution. The controller 970, as described in the example with reference to step 1410 of FIG. 14, may perform the operation that is related to the negotiation between the first audible device 510 and the second audible device 520. The controller 970 may establish a connection with the electronic device 400, and may switch the role of the second audible device 520 from a slave to a master.

In step 1613, the controller 970 may perform an operation that is related to the connection-unrelated work distribution after the connection with the electronic device 400 and the role change. The controller 970, as described in the example with reference to step 1430 of FIG. 14, may perform an operation that is related to the negotiation between the first audible device 510 and the second audible device 520. The controller 970 may receive the work, which was previously configured (allocated) to the first audible device 510, and the context that is related to the corresponding work, and may distribute the received work in addition to the work, which was previously configured (allocated) to the second audible device 520. The controller 970 may perform the previously configured work of the second audible device 520, and, at the same time, may continuously perform the redistributed work based on the received context, following the work executed in the first audible device 510.

If the received data is not the power-off notification in step 1605 (No in step 1605), the controller 970 may determine whether or not the received data corresponds to the work redistribution notification in step 1615. The controller 970 may receive, from the first audible device 510, the work redistribution notification according to the adjustment of the workload ratio. The controller 970 may receive a non-wearing (e.g., taking-off) notification from the first audible device 510, and, in response to the non-wearing notification, may determine the state in which the first audible device 510 is not available (e.g., taking-off) in order to thereby determine the work redistribution of the first audible device 510 and the second audible device 520.

If the received data is not the work redistribution notification in step 1615 (No in step 1615), the controller 970 may process the execution of the corresponding operation in step 1617. For example, the controller 970 may receive sound source data from the first audible device 510, and may process an operation that is related to the output of the received sound source data through the speaker.

If the received data is the work redistribution notification in step 1615 (Yes in step 1615), the controller 970 may perform an operation that is related to the connection-related work distribution with the first audible device 510 connected and/or an operation that is related to the connection-unrelated work distribution in step 1619.

In the case where the controller 970 is not connected with the electronic device 400, the controller 970 may not perform the operation that is related to the connection-related work distribution in FIG. 16, and may perform the operation that is related to the connection-unrelated work distribution between the first audible device 510 and the second audible device 520.

When the controller 970 determines the state in which the second audible device 520 is not available (e.g., a low battery) based on the second battery level of the second audible device 520, the controller 970 may transmit a power-off notification of the second audible device 520 to the first audible device 510. In this case, in response to the work redistribution notification of the first audible device 510, the controller 970 may process the execution of the operation that is related to the aforementioned connection-related work and/or connection-unrelated work.

Figure 17:
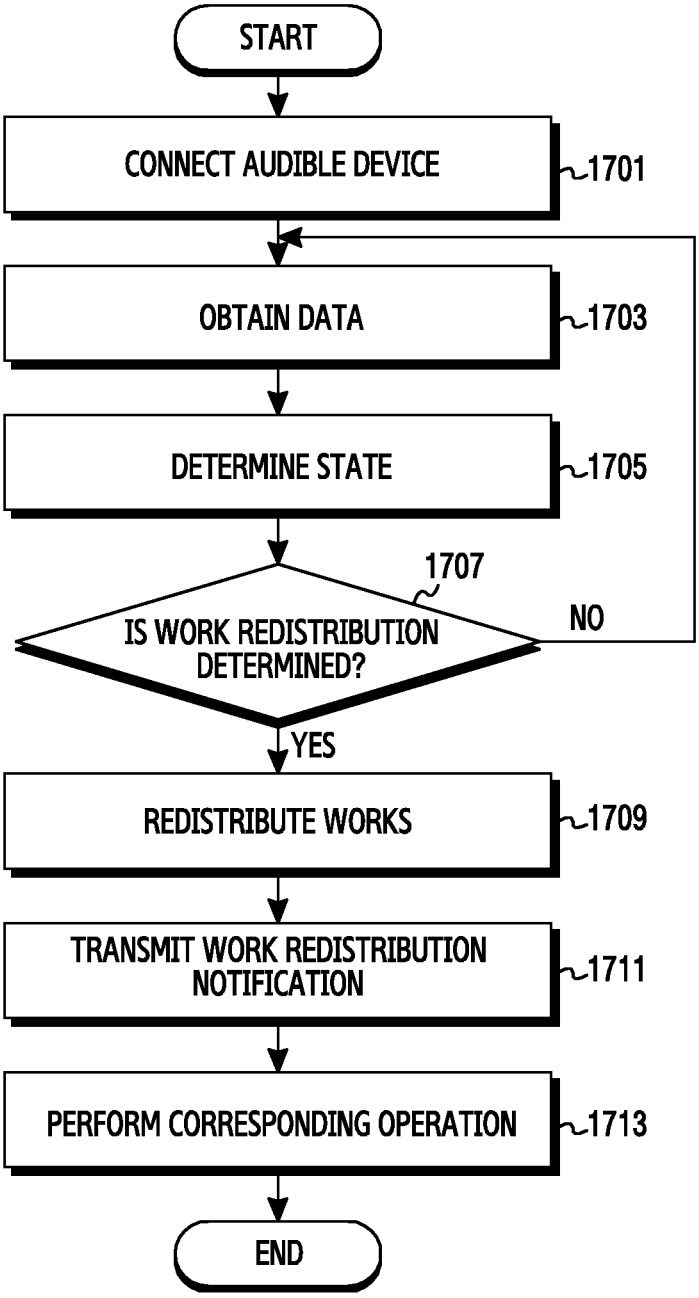
FIG. 17 is a flowchart of a method of the electronic device, according to an embodiment of the present disclosure.

FIG. 17 is a flowchart of a method of the electronic device, according to an embodiment of the present disclosure.

Referring to FIG. 17, in step 1701, the controller 880 of the electronic device 400 may establish a connection with one of a pair of audible devices 500 (e.g., the first audible device 510 and the second audible device 520). For example, the electronic device 400 may establish a connection with the first audible device 510 that operates as a slave with respect to the electronic device 400 and operates as a master with respect to the other audible device 500 among the audible devices 500.

The electronic device 400 and the first audible device 510 may be connected with each other by the first wireless communication, and the first audible device 510 and second audible device 520 may be connected with each other by the second wireless communication. In this case, the first audible device 510, which is connected with the electronic device 400 by the first wireless communication, may be a slave device with respect to the electronic device 400, and may be a master device with respect to the second audible device 520, which is connected by the second wireless communication. The second audible device 520, which is not connected with the electronic device 400, may be a slave device with respect to the first audible device 510, which is connected by the second wireless communication.

The master/slave operation between the first audible device 510 and the second audible device 520 of the audible devices 500 may be pre-configured, and the electronic device 400 may establish a connection with the audible device 500, which is configured to be a master, through the first wireless communication. The electronic device 400 may determine the audible device to which the electronic device 400 attempts to connect among the first audible device 510 and the second audible device 520. For example, the electronic device 400 may compare the state information (e.g., the channel state, the signal strength, the battery level, or the wearing state) of the first audible device 510 with the state information (e.g., the channel state, the signal strength, the battery level, or the wearing state) of the second audible device 520, and may determine the audible device that has better state information (e.g., a good channel state, a strong signal strength, a high battery level, or the state in which the audible device is worn) to be a master device in order to thereby attempt to connect thereto.

The first wireless communication and the second wireless communication may be the same communication scheme, or may be different communication schemes. For example, the first wireless communication and the second wireless communication may include wireless communication, such as BT, BLE, or NFMI. The first wireless communication and the second wireless communication are not limited thereto, and may include a variety of other wireless communication schemes, such as WiFi, NFC, ZigBee, UWB, or IrDA.

In step 1703, the controller 880 may obtain data from the connected audible device 500 (e.g., the first audible device 510). The data may contain the first data that is related to the first audible device 510 and the second data that is related to the second audible device 520. The first data may contain data that is related to state information (e.g., the battery level of the first audible device 510 (e.g., the remaining amount of battery included in the first audible device 510, hereinafter, referred to as the first battery level)), wearing information, or taking-off information of the first audible device 510. The second data may contain data that is related to state information (e.g., the battery level of the second audible device 520 (e.g., the remaining amount of battery included in the second audible device 520, hereinafter, referred to as the second battery level)), wearing information, or taking-off information of the second audible device 520.

The controller 880 may obtain the first data and the second data from the first audible device 510 in the case where the electronic device 400 and the first audible device 510 of a master are connected with each other. For example, the first audible device 510 may receive the second data from the second audible device 520, and may provide the electronic device 400 with the first data of the first audible device 510 and the second data of the second audible device 520, which is received from the second audible device 520.

In step 1705, the controller 880 may determine the state of the audible device 500 (e.g., the first audible device 510 or the second audible device 520) based on the first data and the second data, which are obtained.

For example, the controller 880 may determine the first battery level of the first audible device 510 (e.g., the remaining amount of the battery of the first audible device 510) based on the first data, and may determine the second battery level of the second audible device 520 (e.g., the remaining amount of battery of the second audible device 520) based on the second data.

For example, the controller 880 may determine whether or not the first audible device 510 is in use by the user (e.g., wearing or non-wearing) based on the first data, and may determine whether or not the second audible device 520 is in use by the user (e.g., wearing or non-wearing) based on the second data.

For example, the controller 880 may determine whether or not the first audible device 510 is expected to be turned off based on the first data (e.g., the first battery level), and may determine whether or not the second audible device 520 is expected to be turned off based on the second data (e.g., the second battery level). The controller 880 may compare the first battery level with the second battery level, and may determine which battery level is higher among first battery level and the second battery level based on the comparison result.

In step 1707, the controller 880 may determine whether or not the work redistribution is to be made. When it is determined that the adjustment of the workload ratio between the first audible device 510 and the second audible device 520 is required based on the obtained data, the controller 880 may determine the work redistribution of the first audible device 510 and the second audible device 520. When it is determined that one of the first audible device 510 or the second audible device 520 is not available (e.g., taking-off, a low battery, or power-off) based on the obtained data, the controller 880 may determine the work redistribution of the first audible device 510 and the second audible device 520.

If the work redistribution is not determined in step 1707 (No in step 1707), the controller 880 may proceed to step 1703 in order to thereby process the execution of step 1703 and subsequent steps.

If the work redistribution is determined in step 1707 (Yes in step 1707), the controller 970 may redistribute the works that are configured (allocated) to the first audible device 510 and the second audible device 520 in step 1709.

The controller 880 may determine the workload ratio by the battery ratio of the first audible device 510 and the second audible device 520 in order to thereby distribute the works according to the result thereof. For example, the controller 880 may redistribute the works from a master and Work 1 to a slave and Work 2 with respect to the first audible device 510, and may redistribute the works from a slave and Work 2 to a master and Work 1 with respect to the second audible device 520.

If one audible device is expected to be turned off due to a low battery, the controller 880 may redistribute the works of the audible device, which is expected to be turned off, to the other audible device according to the result thereof. For example, if the audible device, which is expected to be turned off, is a master device, the controller 880 may redistribute the master and the works that are allocated to the audible device, which is expected to be turned off, to the other audible device.

In step 1711, the controller 880 may transmit a work redistribution notification to the audible device 500. For example, the controller 880 may transmit, to the first audible device 510 connected, a work redistribution notification that includes information on the work redistribution and/or a master/slave conversion command.

In step 1713, the controller 880 may process the execution of the corresponding step.

If the master role and the slave role of the first audible device 510 and the second audible device 520 are changed, the controller 880 may make a control to: disconnect from the currently connected audible device (e.g., the first audible device 510); connect to the audible device (e.g., the second audible device 520), of which the role has been changed to a master, by means of a direct pairing; and perform the related works based on the connected audible device.

The controller 880 may store connection information for connecting to the first audible device 510 or the second audible device 520, or may obtain the same from the first audible device 510, which is connected. The connection information may contain the MAC addresses and/or security information of the first audible device 510 and the second audible device 520. The controller 880 may recognize the connection information of the audible devices 500 in the course of the pairing the electronic device 400 with the audible devices 500, and the controller 880 may cache the connection information to then reuse the same in the next conversion step.

Figure 18:
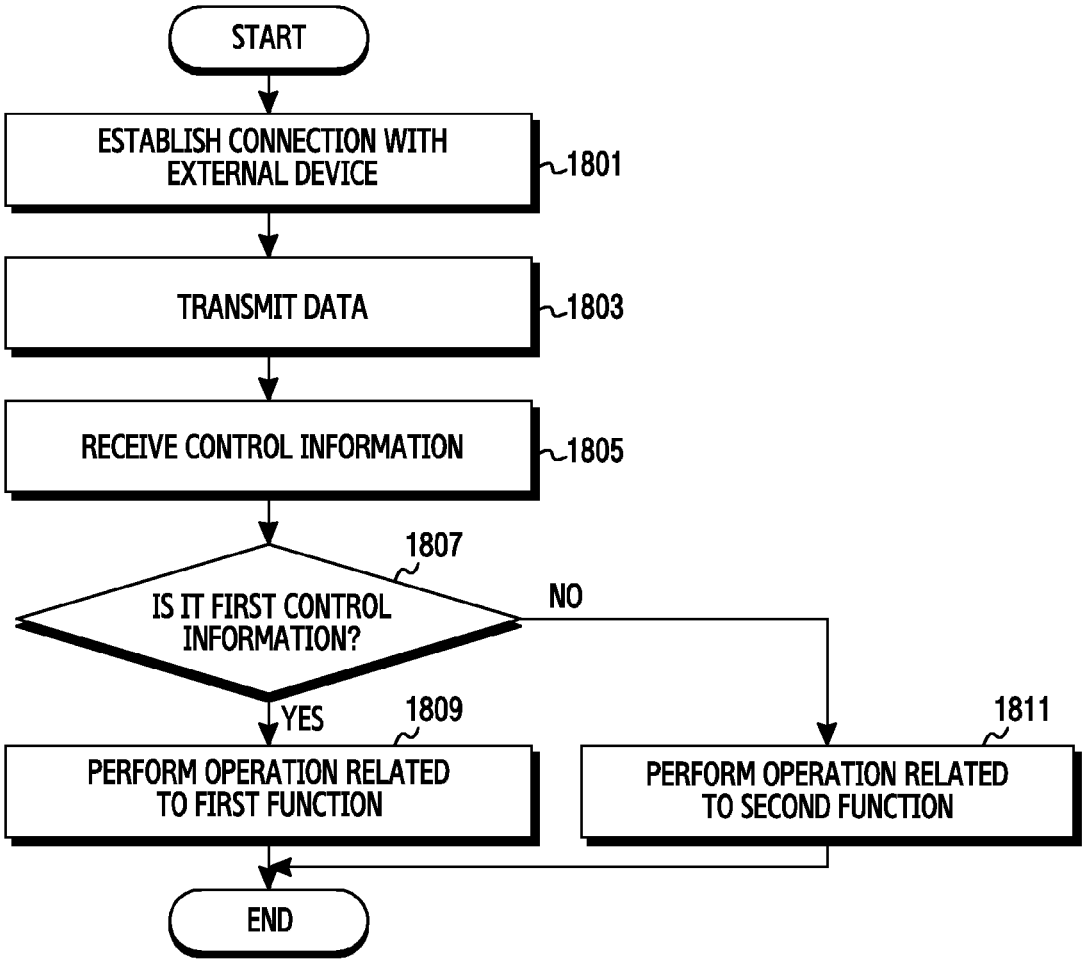
FIG. 18 is a flowchart of a method of the audible device, according to an embodiment of the present disclosure.

FIG. 18 is a flowchart of a method of the audible device, according to an embodiment of the present disclosure. FIG. 18 shows a method in the case where the audible device 500 is a master device and is passively operated according to the work distribution of the electronic device 400.

Referring to FIG. 18, in step 1801, the controller 970 of the audible device 500 may establish a connection with an external device. For example, provided that the audible device 500 is the first audible device 510 in FIG. 18, the first audible device 510 may establish a connection with the electronic device 400 by the first wireless communication. In various embodiments, the first audible device 510 may establish a connection with the second audible device 520 of a slave device by the second wireless communication. In various embodiments, the first wireless communication and the second wireless communication may be the same communication scheme, or may be different communication schemes.

In step 1803, the controller 970 may transmit data to the connected electronic device 400. The controller 970 may transmit, to the electronic device 400, the first data related to the first audible device 510 (e.g., the first battery level, wearing information, or taking-off information of the first audible device 510) and the second data related to the second audible device 520 (e.g., the second battery level, wearing information, or taking-off information of second audible device 520), which is received from the second audible device 520.

The controller 970 may receive control information from the connected electronic device 400 in step 1805, and may determine whether the received control information corresponds to the first control information or the second control information in step 1807. The first control information may contain a work redistribution notification that allows the audible device 500 to perform the dynamic work distribution operation (e.g., the first function). The second control information may contain information that allows the audible device 500 to perform the operation (e.g., the second function) that is instructed by the electronic device 400.

If it is determined that the received control information is the first control information in step 1807 (Yes in step 1807), the controller 970 may process the execution of the corresponding step based on the first control information in step 1809. The controller 970 may process the execution of the step related to the first function in response to the work redistribution notification received from the electronic device 400. The controller 970 may process the execution of the step related to the connection-related work distribution between the first audible device 510 and the second audible device 520 and/or the connection-unrelated work redistribution in response to the work redistribution notification. For example, the controller 970 may process the execution of at least one of the steps of: changing the roles between the first audible device 510 and the second audible device 520 (e.g., a master↔a slave); disconnecting from the electronic device 400 according to the role change and establishing a connection with the electronic device 400 by the other audible device; exchanging works; and distributing works.

If it is determined that the received control information is the second control information in step 1807 (No in step 1807), the controller 970 may process the execution of the corresponding steps based on the second control information in step 1811. The controller 970 may process the execution of the step related to the second function in response to the data or commands received from the electronic device 400. The controller 970 may receive, from the electronic device 400, the first audio streaming for the first audible device 510 and the second audio streaming for the second audible device 520. The controller 970 may process the first audio streaming to be output through the speaker, and may process the second audio streaming to be transmitted to the second audible device 520 connected and to then be output through the speaker of the second audible device 520.

As described above, the electronic device 400 or the audible device 500, for example, may perform the dynamic work distribution based on the battery level and the wearing state of the audible device 500. According to an embodiment, it may be assumed that the first battery level of the first audible device 510 is higher than the second battery level of the second audible device 520, and it may be assumed that the first audible device 510 is not worn (e.g., the second audible device 520 is worn) on the user. In this case, even though the battery level of the first audible device 510 is higher than the battery level of the second audible device 520, when the second audible device 520 is worn on the user, the electronic device 400 or the audible device 500 may process the works corresponding to the first audible device 510 to be performed by the second audible device 520. In addition, in the case where the first audible device 510 is a master device, the roles may be changed between the first audible device 510 and the second audible device 520 such that the second audible device 520 may operate as a master device.

Figure 19:
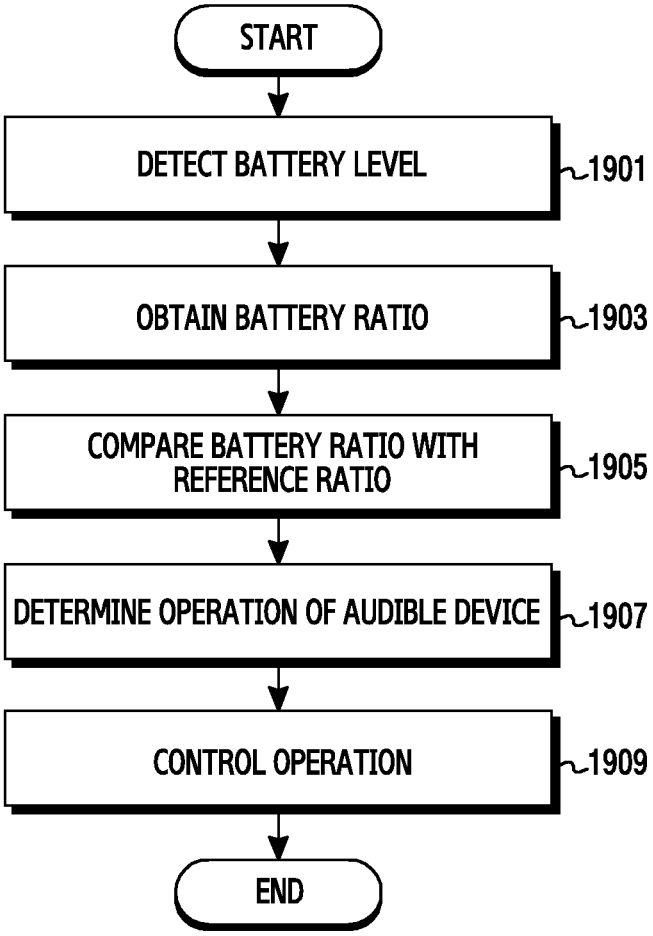
FIG. 19 is a flowchart of a dynamic work distributing method of the audible device, according to an embodiment of the present disclosure.

FIG. 19 is a flowchart of a dynamic work distributing method of the audible device, according to an embodiment of the present disclosure.

Referring to FIG. 19, in step 1901, the controller 970 of the audible device 500 may detect the battery level. The controller 970 may detect the battery level of the audible device (e.g., the first audible device 510) and the battery level of the other connected audible device (e.g., the second audible device 520). The controller 970 may establish a connection with the other audible device based on the wireless communication circuit, and may receive the battery level of the other audible device (hereinafter, the second battery level) by using the wireless communication circuit. The controller 970 may detect the battery level of the audible device 500 (hereinafter, the first battery level) in response to the reception of the second battery level.

In step 1903, the controller 970 may obtain the battery ratio between the first battery level and the second battery level. The battery ratio may correspond to the examples described with reference to Table 1 to Table 7 above.

In step 1905, the controller 970 may compare the battery ratio and the reference ratio. The controller 970 may compare at least one of a plurality of reference ratios with the battery ratio. A plurality of reference ratios may correspond to the examples described with reference to Table 1 to Table 7 above, and, for example, may correspond to the workload ratios of the first audible device 510 and the second audible device 520.

In step 1907, the controller 970 may determine the operation (e.g., at least one of the role conversion or the work distribution) of the audible device 500. For example, the controller 970 may determine the role conversion and/or the work distribution for at least one of the first audible device 510 or the second audible device 520 based on at least some of the comparison result. The controller 970 may determine a reference ratio that is closest to the battery ratio among the plurality of reference ratios, and may determine the step corresponding to the determined reference ratio.

In step 1909, the controller 970 may control the operation of at least one of the first audible device 510 or the second audible device 520 based at least some of the determination. The controller 970 may operate to convert the role of at least one of the first audible device 510 or the second audible device 520 and to redistribute the works of at least one of the first audible device 510 or the second audible device 520.

Figure 20:
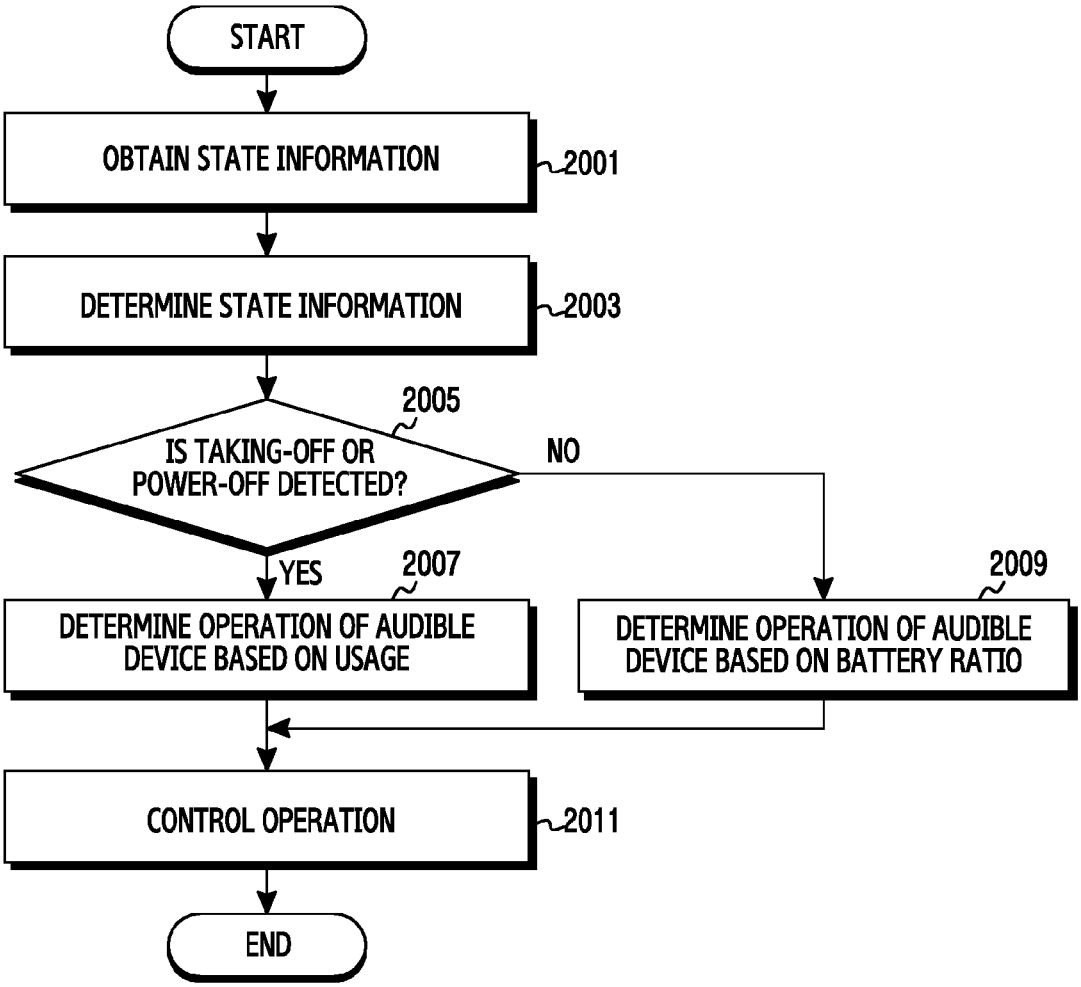
FIG. 20 is a flowchart of a dynamic work distributing method of the audible device, according to an embodiment of the present disclosure.

FIG. 20 is a flowchart of a dynamic work distributing method of the audible device, according to an embodiment of the present disclosure.

Referring to FIG. 20, in step 2001, the controller 970 of the audible device 500 may obtain state information. The controller 970 may obtain state information of the audible device (e.g., the first audible device 510) and state information of the other connected audible device (e.g., the second audible device 520). The controller 970 may establish a connection with the other audible device based on the wireless communication circuit, and may receive the state information of the other audible device (hereinafter, the second state information) by using the wireless communication circuit. The controller 970 may obtain the state information of the audible device 500 (hereinafter, the second state information) in response to the reception of the state information.

In step 2003, the controller 970 may determine the state information. For example, the controller 970 may analyze and determine the state of the audible device 500 based on at least some of the first state information related to the first audible device 510 and the second state information related to the second audible device 520.

In step 2005, the controller 970 may determine whether or not taking-off or power-off of at least one of the first audible device 510 or the second audible device 520 is detected based on at least some of the determination result.

If the state of one of the first audible device 510 or the second audible device 520 corresponds to the taking-off state or the power-off expectation state in step 2005 (Yes in step 2005), the controller 970 may determine the operation of at least one of the first audible device 510 or the second audible device 520 based on the usage (wearing) state in step 2007. The controller 970 may convert the roles of the first audible device 510 and the second audible device 520, and may determine the work redistribution such that the works of the audible device, which is taken off or of which the power is expected to be turned off, may be performed by the other audible device.

If the first audible device 510 and the second audible device 520 do not correspond to the taking-off state or the power-off expectation state in step 2005 (No in step 2005), the controller 970 may determine the operation of at least one of the first audible device 510 or the second audible device 520 based on the battery ratio in step 2009. The controller 970 may determine the role conversion and/or the work distribution for at least one of the first audible device 510 or the second audible device 520 based on the battery ratio.

In step 2011, the controller 970 may control the operation that is determined in step 2007 or step 2009. The controller 970 may operate to convert the role of at least one of the first audible device 510 or the second audible device 520 and to redistribute the works of at least one of the first audible device 510 or the second audible device 520.

As described above, an operating method of the audible device 500 may include: establishing a connection with the other audible device (e.g., the second audible device 520) by using a wireless communication circuit; receiving the second battery level of the other audible device by using the wireless communication circuit; detecting the first battery level of the audible device (e.g., the first audible device 510); obtaining the battery ratio between the first battery level and the second battery level; comparing the battery ratio with at least one of a plurality of reference ratios; and controlling the operation (e.g., the role conversion or the work distribution) of at least one of the audible device (e.g., the first audible device 510) or the other audible device (e.g., the second audible device 520) based on at least some of the comparison.

The operation may include the operation of at least one of the electronic component of the audible device or the electronic component of the other audible device.

The method may include an operation in which the control circuit of the audible device 500 controls the operation such that the audible device operates as a master device and the other audible device operates as a slave device, or such that the other audible device operates as a master device and the audible device operates as a slave device.

The electronic component of the audible device 500 may include a sensor, and the sensor, for example, may include a biometric sensor.

The electronic component includes an audio player, and the method may include an operation in which the control circuit synchronizes the audio player of the audible device with the audio player of the other audible device.

The audible device includes the first earphone, and the other audible device includes the second earphone, wherein the method may include an operation in which the control circuit synchronizes the first earphone with the second earphone.

The method may include an operation in which the control circuit controls the operation of at least one of the role conversion or the work redistribution of the audible device and the other audible device based on at least some of state information of the audible device and the other audible device.

The state information may contain at least one of the battery level or the wearing state information.

The method may include an operation in which the control circuit determines a reference ratio that is close to the battery ratio among the plurality of reference ratios, and controls the operation of at least one of the first member or the second member based on at least some of the determination.

The reference ratio may include the workload ratio of the audible device and the other audible device.

As described above, an operating method of the electronic device 400 may include: establishing a connection with one of the first audible device 510 or the second audible device 520 by using a wireless communication circuit (e.g., the wireless communication unit 810); receiving the first data related to the first audible device 510 and the second data related to the second audible device 520 from the one connected audible device by using the wireless communication circuit; and controlling the operation (e.g., the role conversion or the work distribution) of at least one of the first audible device 510 or the second audible device 520 based on at least some of the first data or the second data.

The method may include an operation in which the processor controls the operation such that the first audible device 510 operates as a master device and the second audible device 520 operates as a slave device, or such that the second audible device 520 operates as a master device and the first audible device 510 operates as a slave device.

The method may include an operation in which the processor controls the operation of at least one of the role conversion or the work redistribution of the first audible device 510 or the second audible device 520 based on at least some of the first data of the first audible device 510 and the second data of the second audible device 520.

The data may contain at least one of the battery level or the wearing state information.

The method may include an operation in which the processor: obtains the battery ratio between the first audible device 510 and the second audible device 520 based on at least some of the first data and the second data; compares the obtained battery ratio with a plurality of reference ratios; determines a reference ratio that is close to the battery ratio among the plurality of reference ratios based on at least some of the comparison; and controls the operation of at least one of the first audible device 510 or the second audible device 520 based on at least some of the determination.

The reference ratio may include the workload ratio of the first audible device 510 and the second audible device 520.

According to a work distribution method of an audible device and a device thereof, the works can be dynamically distributed in the double-ear type of wireless audible device in order to thereby provide the low power operation and in order to thereby improve the usability.

It is possible to seamlessly adjust works between the audible devices in consideration of the battery level and the wearing state.

In the double-ear type of wireless audible device, the remaining amount of battery may be maintained to be similar between the audible devices so that the user can use a stereo headset for a long period of time.

Various embodiments disclosed herein are provided merely to easily describe technical details of the present disclosure and to help the understanding of the present disclosure, and are not intended to limit the scope of the present disclosure. Therefore, it should be construed that all modifications and changes or modified and changed forms based on the technical idea of the present disclosure fall within the scope of the present disclosure.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. An audible device comprising:

a battery which is rechargeable;

a power management circuit configured to detect a first battery level of the battery;

a wireless communication circuit configured to communicate with another audible device by wireless communication;

an electronic component; and a control circuit electrically connected with the power management circuit, the wireless communication circuit, and the electronic component, wherein the control circuit is configured to:

establish a connection with the another audible device by using the wireless communication circuit;

receive data regarding a second battery level of the another audible device by using the wireless communication circuit;

obtain information indicating a difference between the first battery level and the second battery level;

identify, based on the obtained information, whether to change an operation mode of the another audible device; and transmit, based on identifying whether to change the operation mode of the another audible device, a signal for changing the operation mode of the another audible device, to the another audible device by using the wireless communication circuit.

2. The audible device according to claim 1, wherein the control circuit is further configured to:

identify, based on the obtained information, whether to change the operation mode of the audible device; and change, based on identifying whether to change the operation mode of the audible device, the operation mode of the audible device.

3. The audible device according to claim 2, wherein the signal is transmitted for changing the operation mode of the another audible device from a slave mode to a master mode, and wherein the processor is further configured to change the operation mode of the audible device from the master mode to the slave mode, based on identifying whether to change the operation mode of the audible device.

4. The audible device according to claim 1, wherein the electronic component includes a biometric sensor, and wherein the control circuit is further configured to:

detect, by the biometric sensor, whether the audible device is worn on a portion of a body of a user;

based on detecting whether the audible device is worn on the portion of the body of the user, identify whether to change the operation mode of the audible device by using the obtained information; and based detecting whether the audible device is worn on the portion of the body of the user, identify whether to change the operation mode of the another audible device by using the obtained information.

5. The audible device according to claim 1, wherein the audible device includes a first earphone, wherein the another audible device includes a second earphone, and wherein the control circuit is further configured to synchronize the first earphone with the second earphone.

6. The audible device according to claim 1, wherein the obtained information comprises information indicating a battery ratio between the first battery level and the second battery level.

7. The audible device according to claim 6, wherein the control circuit is further configured to:

identify, among a plurality of reference ratios associated with a plurality of operations, a reference ratio that is closest to the battery ratio;

identify whether to change the operation mode of the audible device, as an operation associated with identified reference ratio; and identify whether to change the operation mode of the another audible device, as an operation associated with identified reference ratio.

8. The audible device according to claim 7, wherein the reference ratio includes a workload ratio between a value indicating a workload of the audible device and a value indicating a workload of the another audible device.

9. The audible device according to claim 1, wherein the control circuit is further configured to identify whether to change the operation mode of the another audible device, for assigning at least one of operations allocated to the another audible device to the audible device.

10. The audible device according to claim 1, wherein the control circuit is further configured to identify whether to change the operation mode of the audible device, for assigning at least one of operations allocated to the audible device to the another audible device.

11. An electronic device comprising:

a wireless communication circuit; and a processor, wherein the processor is configured to:

establish a connection with a first audible device among audible devices by using the wireless communication circuit, wherein the first audible device is configured as a master device among the audible devices, based on establishing the connection with the first audible, and wherein the audible devices further comprise a second audible device configured as a slave device among the audible devices, receive, from the first audible device, information including first data for indicating a first battery level of the first audible device and second data for indicating a second battery level of a second audible device, wherein the second data is provided from the second audible device to the first audible device, obtain information indicating a difference between the first battery level and the second battery level;

identify whether to change an operation mode of the first audible device, based on the obtained information; and transmit, through the connection to the first audible device, a first signal for changing the operation mode of the first audible device.

12. The electronic device according to claim 11, wherein the processor is further configured to:

identify whether to change an operation mode of the second audible device, based on the obtained information; and transmit, through the connection to the first audible device, a second signal to the first audible device, wherein the first audible device is configured to transmit, in response to receiving the second signal, a third signal for changing the operation mode of the second audible device.

13. The electronic device according to claim 12, wherein the first signal includes a signal for changing a master mode to a slave mode, and wherein the third signal includes a signal for changing the slave mode to the master mode.

14. The electronic device according to claim 12, wherein the information indicating the difference between the first battery level and the second battery level comprises information indicating a battery ratio between the first battery level and the second 1 battery level, and wherein the processor is further configured to:

identify among a plurality of reference ratios associated with a plurality of operations, a reference ratio that is the closest to the battery ratio; and identify whether to change the operation mode of the first audible device and identify whether to change the operation mode of the second audible device, as an operation associated with the identified reference ratio.

15. The electronic device according to claim 14, wherein the reference ratio includes a workload ratio between a value indicating a workload of the first audible device and a value indicating a workload of the second audible device.

16. An operating method of an audible device, the method comprising:

establishing a connection with another audible device by using a wireless communication circuit;

detecting a first battery level of the audible device;

receiving data regarding a second battery level of the another audible device by using the wireless communication circuit;

obtaining information indicating a difference between the first battery level and the second battery level;

identifying, based on the obtained information, whether to change an operation mode of the audible device;

identifying, based on the information, whether to change an operation mode of the another audible device;

changing, based on identifying whether to change the operation mode of the audible device, the operation mode of the audible device; and transmitting, based on identifying whether to change the operation mode of the another audible device, a signal for changing the operation mode of the another audible device, to the another audible device by using the wireless communication circuit.

17. The method of claim 16, wherein changing the operation mode of the audible device comprises:

changing the operation mode of the audible device from a master mode to a slave mode, wherein transmitting a signal for changing the operation mode of the another audible device to the another audible device by using the wireless communication circuit comprises:

transmitting a signal for changing the operation mode of the audible device from the master mode to the slave mode.

18. The method of claim 16, wherein the audible device includes a first earphone, wherein the another audible device includes a second earphone, and wherein the method further comprises synchronizing the first earphone with the second earphone.

19. The method of claim 16, wherein the obtained information comprises information for indicating a battery ratio between the first battery level and the second battery level.

20. The method of claim 19, further comprising:

identifying, among a plurality of reference ratios associated with a plurality of operations, a reference ratio that is closest to the battery ratio;

identifying whether to change the operation mode of the audible device, as an operation associated with the identified reference ratio; and identifying whether to change the operation mode of the another audible device, as an operation associated with the identified reference ratio, wherein the reference ratio includes a workload ratio between a value indicating workload of the audible device and a value indicating workload of the another audible device.

* * * * *